US010538889B2

(12) United States Patent
Ragsdale, Jr.

(10) Patent No.: US 10,538,889 B2
(45) **Date of Patent: *Jan. 21, 2020**

(54) BERM OR LEVEE EXPANSION SYSTEM AND METHOD

(71) Applicant: Larry J Ragsdale, Jr., Webster, TX (US)

(72) Inventor: Larry J Ragsdale, Jr., Webster, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/685,474

(22) Filed: Aug. 24, 2017

(65) Prior Publication Data

US 2018/0340305 A1 Nov. 29, 2018

Related U.S. Application Data

(63) Continuation-in-part of application No. 15/603,834, filed on May 24, 2017.

(51) Int. Cl.

| | |
|---|---|
| ***E02B 3/10*** | (2006.01) |
| ***E02D 17/18*** | (2006.01) |
| ***E02B 3/12*** | (2006.01) |

(52) U.S. Cl.

CPC ..... *E02B 3/126* (2013.01); *E02B 3/10* (2013.01); *E02D 2300/002* (2013.01); (Continued)

(58) Field of Classification Search

CPC ..... E02D 17/18; E02D 7/06; E02D 3/10
See application file for complete search history.

(56) References Cited

U.S. PATENT DOCUMENTS

| | | | |
|---|---|---|---|
| 4,521,131 A | 6/1985 | Nandlal | |
| 5,605,416 A | 2/1997 | Roach | |

(Continued)

FOREIGN PATENT DOCUMENTS

| | | | |
|---|---|---|---|
| FR | 2565271 A1 * | 12/1985 | ..... E02B 7/005 |
| JP | 2006045814 | 2/2006 | |
| WO | WO9739195 | 4/1997 | |

OTHER PUBLICATIONS

Rohe; Why 30 mil PVC is equivalent to 60 mil HDPE; Janruary 2015; Failure at Yield Elongation (Year: 2015).*

(Continued)

*Primary Examiner* — Benjamin F Fiorello
(74) *Attorney, Agent, or Firm* — David McEwing

(57) ABSTRACT

A system and method to create or elevate a berm of a liquid retention facility by placement of lightweight fill material anchored by impervious liner material(s). The liner materials can be part of the liquid retention pond. The system and method can also be used to elevate the height of the berm in combination with impervious liner retention material. By constructing the berm system on an existing berm, earth embankment or levee, the effective height of the system structure can be increased. The liquid impervious liner material provides a watertight surface, joining media, and the anchoring of the lightweight fill material to the existing berm. The system may use solid wall hollow body structures. The system may also use flexible and liquid porous geotextile structures including geotubes. The liquid impervious liners retain the liquid in the retention pond.

8 Claims, 24 Drawing Sheets

STRUCTURAL FILL

(52) U.S. Cl.
CPC ..... *E02D 2300/0007* (2013.01); *E02D 2300/0009* (2013.01); *E02D 2300/0015* (2013.01); *E02D 2300/0029* (2013.01); *E02D 2300/0079* (2013.01); *E02D 2600/30* (2013.01)

(56) References Cited

U.S. PATENT DOCUMENTS

| | | | | |
|---|---|---|---|---|
| 5,971,661 | A | 10/1999 | Johnson et al. | |
| 6,012,872 | A | 1/2000 | Perry et al. | |
| 6,079,904 | A * | 6/2000 | Trisl | E02B 3/106 405/107 |
| 6,146,054 | A | 11/2000 | Tessonneau | |
| 6,390,154 | B1 | 5/2002 | Hall | |
| 6,957,928 | B1 * | 10/2005 | Lofton | E02B 3/108 405/111 |
| 7,214,005 | B1 | 5/2007 | Davis | |
| 7,574,834 | B2 | 8/2009 | Murray | |
| 7,708,495 | B1 | 5/2010 | Antee | |
| 8,361,261 | B2 | 1/2013 | Van Fossen | |
| 8,376,657 | B2 | 2/2013 | Dudding | |
| 9,528,236 | B2 * | 12/2016 | Vickers | E02B 3/10 |
| 2003/0156903 | A1 | 8/2003 | Wiseman et al. | |
| 2004/0047688 | A1 | 3/2004 | Clement | |
| 2004/0234340 | A1 | 11/2004 | Cho et al. | |
| 2006/0133897 | A1 * | 6/2006 | Allard | E02B 3/04 405/43 |
| 2006/0280563 | A1 | 12/2006 | Glick | |
| 2007/0280789 | A1 * | 12/2007 | Mason | E02B 3/04 405/302.6 |
| 2008/0131212 | A1 * | 6/2008 | Quinley | E02B 3/10 405/302.6 |
| 2008/0201931 | A1 | 8/2008 | West | |
| 2011/0135394 | A1 | 6/2011 | Dudding | |
| 2011/0206458 | A1 | 8/2011 | Jones et al. | |
| 2012/0261414 | A1 | 10/2012 | Mann et al. | |
| 2013/0071188 | A1 * | 3/2013 | Taylor | E02B 7/20 405/114 |
| 2013/0089376 | A1 * | 4/2013 | Nolt | B65G 5/00 405/53 |
| 2013/0105475 | A1 | 5/2013 | Marshall | |
| 2013/0200079 | A1 | 8/2013 | Mann et al. | |
| 2015/0191888 | A1 | 7/2015 | Karsten | |

OTHER PUBLICATIONS

GEOTEC Associates, Jack Fowler, Proposed Alternative for Raising Mississipp Levees Using Geotube Technology Developed Under the Corps of Engineers' Construction Productivity Research Program (CPAR), Nov. 1, 1996.

Fred Pinkard, Thad Pratt, Donald Ward, Tina Holmes, Julie Kelley, Landris Lee, George Sills, Eric Smith, Perry Taylor, Nalini Torres, Lillian Wakeley, Johannes Wilowo, Flood-Fighting Structures Demonstration and Evaluation Program: Laboratory and Field Testing in Vicksburg Mississippi, Jul. 2007, Coastal and Hydraulics Laboratory, US Army Engineer Research and Development Center, Vicksburg MS.

Bladder Dike MPE 20, https://containmentcorp.com/product/bladder-dike-mpe-20/.

* cited by examiner

FIG-1 CROSS SECTION OF TYPICAL CONTAINMENT POND

FIG-2 TYPICAL SECTION OF DOUBLE LINED LEVEE

FIG-3 TYPICAL SECTION OF EMBODIMENT-A

FIG-4 TYPICAL SECTION OF EXISTING EARTHEN LEVEE

FIG-5 TYPICAL SECTION OF EMBODIMENT-B

FIG-6 TYPICAL SECTION, EMBODIMENT-B, ARMORED

FIG-7 TYPICAL SECTION, EMBODIMENT-C, ARMORED AS LINER

FIG-8 EMBODIMENT-D NEW LINER

FIG-9 CONCRETE FOUNDATION

FIG–10 STACKED CONFIGRATION EMBODIMMENT–E

FIG–11 WEIGHTED SECTION, EMBODIMENT–F

FIG-12 TWO SOIL ANCHOR POINTS

FIG–13 TWO ANCHOR TRENCHES

FIG-14 INTERIOR LEVEE (CONTAINED FLOUID ON BOTH SIDES)

FIG-15 STRUCTURAL FILL

FIG-16 ANCHORED STRUCTURAL ELEMENT

FIG-17 SOLID HOLLOW WALL WITH INTERNAL BRACING

FIG-18 THIN WALLED TUBE

BERM OR LEVEE EXPANSION SYSTEM AND METHOD

RELATED DOCUMENTS

This Application is a Continuation in Part of application Ser. No. 15/603,834 entitled "Berm or Levee Expansion System and Method filed May 24, 2017 and a Continuation in Part of application Ser. No. 14/731,553 entitled "Berm or Levee Expansion System and Method" filed Jun. 5, 2015. These applications are incorporated herein by reference in its entirety. This Application also claims the benefit and priority to provisional application entitled "Berm or Levee Expansion System and Method, Application No. 62/008,662 filed Jun. 6, 2014. This provisional application is also incorporated herein by reference in its entirety.

1. FIELD OF USE

The method and system of this disclosure pertains to economical expansion of capacity of liquid retention structures such as levees, berms, retention ponds, waste water retention ponds and similar structures. The expansion of capacity can be achieved with an expedited construction schedule wherein the structure utilizes lightweight materials.

2. BACKGROUND OF THE DISCLOSURE

Embankments or berms are widely used in civil, industrial, and municipal applications for reservoirs for the retention and storage of liquids. As used in this disclosure, embankments, levees, retention dikes, dams and berms will collectively be referred to as berms. The liquids stored by these berms can range from storm water to hazardous materials such as fracing water or industrial process by-products. Industrial reservoirs are typically land-locked within existing facilities with little or no room to expand the reservoir in a horizontal direction due to adjacent structures, property owners, buried utilizes, etc. The need for additional reservoir volume capacity may occur for multiple reasons, including but not limited to expansions in process or treatment requirements. For the reasons described above, facility owners are faced with limited options to increase reservoir capacity.

One application of industrial reservoirs is the surface storage of brine solution at salt dome storage facilities. These facilities store hydrocarbon products in underground caverns that have been formed by dissolving salt deposits from naturally occurring salt dome formations. The brine solution is pumped underground to displace the hydrocarbon products out of the storage and into the facility for distribution to downstream facilities. When new product is pumped into the cavern, the brine is displaced through pipe systems to the surface storage reservoirs.

In the State of Texas, for example, regulations require an operating freeboard of 2 to 3 feet between the maximum operating fluid elevation and the top of the berm. Because this freeboard is by nature at the top of the berm and at the widest part of the levee (due to the sloping berm walls as described below), the storage lost to the freeboard requirement can be over 13% of the total available capacity of the reservoir. These reservoir are typically installed to utilize the maximum available footprint and cannot be easily expanded. Land restrictions make it difficult or impossible to add additional reservoirs. It is also expensive to remove and build a new berm wall constructed of soil.

Berms are also common in stationary flood control structures such as levees and dams. There are an estimated 100,000 miles of levees in the United States alone. It is sometimes necessary to raise the effective fluid retention height of these levees due to increases in upstream development that lead to increased runoff and therefore increased flood elevations. This is traditionally done by adding soil to the levee, constructing concrete barrier walls, or adding a gravity fill structure to the crest of the levee. These gravity fill systems rely on the weight of the added structure to resist the fluid pressures from the contained fluid.

SUMMARY OF THE DISCLOSURE

This disclosure teaches a method and system that can regain the pond storage lost by adding berm height and therefore the required freeboard capacity. In this regard, this disclosure can directly help America's energy delivery and storage systems. By simply adding 3-4 feet of berm height to multiple existing ponds, a significant increase in liquid storage capacity can be realized.

In a broad aspect, the disclosure is directed to a liquid retention method and system. In one specific sense, the disclosure relates to raising the height of new or existing berms by installation of the proposed structure/system on top of an existing engineered berm. The method and apparatus of the disclosure pertains to erecting a structure consisting of a unique combination of lightweight fill material at least partially enclosed by an impervious liquid liner material. The liquid impermeable liner material will be attached to a new or existing liner positioned on the face of the berm, or otherwise made impervious by anchoring into or against the existing structure. The proposed structure has no length limit. The lightweight fill structure can be installed around the full perimeter of the berm crest ground surface (the top of the berm surrounding an enclosed pond) or along the full length of a levee. The proposed system (impervious liquid liner and lightweight fill structure) effectively increases the height of the inner sidewall of a levee. This increased height may comprise a regulatory required freeboard for the berm structure, i.e., acting as a barrier only during temporary elevation of the liquid level in the retention pond, etc.

The method and apparatus of the disclosure also includes embodiments wherein the added structure may be a solid wall structure installed on the top of the berm. This can be referred to as a berm height expansion apparatus. For example, the berm height expansion apparatus can comprise a hollow body solid wall structure. An example of such a structure is a hollow plastic pipe. The pipe can have diameters of 24 inches, 36 inches, etc. The pipe can be formed from high density polyethylene (HDPE), polyethylene, fiberglass, concrete material, etc. In one embodiment, lightweight fill material may be placed in the hollow body of the solid wall structure. In another embodiment, the hollow pipe may be filled with sand, silt or similar material that can be hydraulically pumped into the pipe.

In an alternate embodiment, the berm height expansion apparatus may be a frame structure covered with a liquid impermeable liner. The frame structure is not liquid impermeable. The frame can comprise aluminum, galvanized steel or steel. The cross sectional view of the frame structure may be a square, rectangle, triangle or similar geometric shape comprising multiple flat exterior sides. The liner, held in place by the frame structure that is anchored to the berm, retains the liquid within the pond. The frame holds the liner above the surface level of the berm, and thereby raising the liquid retention height. As shown in this alternate embodiment, it is not necessary that the structure, supporting the liner, be liquid impermeable.

The berm height expansion apparatus can be a solid wall, hollow body. The solid wall holds the liquid in the retention pond. The retention mechanism may be supplemented with the liquid impermeable liner. In another embodiment, the berm height expansion apparatus may comprise a frame structure. The structure does not have solid wall. Rather the frame structure holds the liquid impermeable liner above the surface of the top of the berm. The elevated liner serves to increase the liquid holding capacity of the liquid pond. The frame is light weight and can be placed on a berm having a narrow base footprint. The berm height expansion apparatus allows increasing the pond holding capacity when it is otherwise not possible to elevate the berm by the addition of soil or other heavy material.

In yet another embodiment, the materials can be used to create an elevated berm structure by placement of the material (e.g., rigid foam lightweight fill material, solid wall structure having a hollow body or a frame structure covered by a liquid impermeable liner) directly on the natural grade of the ground surface.

In another embodiment, the liquid retention structure can comprise a geotube filled with sand, silt or dredge soils. The geotube can be a geotextile. The geotextile is not required to be liquid impenetrable. The fill material can be pumped into the void or pocket (hollow aperture) of the tube.

The unique combination of materials creates a system that can be installed where traditional earthen, sheetpile, or concrete structures are not feasible or cannot be constructed due to physical limitations such as equipment access, geotechnical concerns, or other constraints.

The lightweight fill material may be comprised of Expanded Polystyrene (EPS), commonly referred to as Geofoam®, or a similar lightweight rigid foam plastic material. Geofoam is a registered trademark of Minova International Limited United Kingdom. Materials having physical characteristics of: density less than 5 pounds per cubic foot, compressive strength greater than 2 psi, and a flexural strength greater than 10 psi can be utilized. These materials will hereinafter be referred to as "lightweight fill material". The liner will typically be High Density Polypropylene (HDPE), although other liner materials such as LDPE, PVC, and polyurea composites (e.g. geotextiles coated with polyurea) are commercially available. HDPE liner thicknesses of 30-120 mils would be typically used for the fluid impermeable liner. These materials may be referred to as liner materials or as liquid impermeable liner material. These materials typically have physical characteristics of: yield strength greater than 60 pounds per inch (per ASTM D 6693), puncture resistance greater than 45 pounds (per ASTM D 4833), and are stabilized for protection against ultraviolet sun damage. A textured surface is available on many liner products and would be desirable in this application, specifically as the textured surface increases the coefficient of friction of the liner surface.

The lightweight fill material has a structure. The structure is different from the solid wall hollow pipe described above. The lightweight fill material also has a different structure than the lightweight frame discussed above. The structure's cross sectional shape would typically be triangular, with approximately 45 degree interior slope and a vertical face on the exterior face. Other shapes, however, are not excluded. The height and width of the structure can vary to fit the physical limitations of the specific installation and are limited by the physical strength of the liner and lightweight fill material, the fluid being contained, and the characteristic of the underlying berm. It will be appreciated that berms are engineered structures with load limits. A typical installation would be no more than 6 feet tall although taller installations are possible. It will be appreciated that in another embodiment, a fabric geotube can be used. Material (sand, silt, etc.) can be pumped into the interior of the geotube. This may be constructed in combination with the lightweight fill. In one embodiment, the geotube may be covered by a taut impermeable liner. Note that combining the stacked lightweight foam fill material with the reinforcing side weight of the filled geotube allows the liquid retention structure that has a narrower footprint than that required by the geotube alone.

The basic installation on an existing earthen berm with an existing impervious HDPE liner system would entail the following activities.

1. Excavation of an anchor trench at the berm crest (or ground surface where there is no berm) for the new liner that will enclose the lightweight fill material.
2. Cleaning the existing primary liner.
3. Temporarily placing the new liner along the berm crest.
4. Attach the new liner to the existing liner by extrusion weld or other adhesive or mechanical methods.
5. Layback new liner to allow placement of lightweight fill material.
6. Placing lightweight fill material along the berm crest (ground surface).
7. Flip liner over the lightweight fill material and install outside edge into anchor trench.
8. Backfill anchor trench.

Another aspect of the disclosure relates to partially enclosing the lightweight material with a liner material that is embedded and anchored into the natural grade (ground surface). This would be an embodiment wherein there is no berm that is being supplemented by the lightweight fill material. In this case the earthen anchor trench will provide the required tensile connection to the liner that is required to prevent movement or overturning of the lightweight fill material. The anchor trench can be specifically designed to optimize the liner embedment into the existing soils in order to maximize the impervious characteristics of the subgrade portion of the assembly. The liner can partially act as an embedded cutoff wall when installed vertically into an anchor trench.

Another aspect of the disclosure is that it provides flexibility in the application of the liner material. Any material that provides the necessary strength to resist overturning and movement of the lightweight fill material (hereinafter "lightweight fill material") could be utilized in order to vary the durability, appearance, and design life of the system. One embodiment of this flexibility would be the application of shotcrete over an impervious HDPE liner. Shotcrete is concrete conveyed through a hose and pneumatically projected at high velocity onto a surface. Shotcrete undergoes placement and compaction at the same time due to the force with which it is projected from the nozzle. It can be impacted onto any type or shape of surface, including vertical or overhead areas The shotcrete would provide a concrete protective layer to protect the assembly from vandalism, accidental impacts, and prevent UV damage to the HDPE liner. This level of protection would be desirable in publicly accessible areas or areas without controlled access, such as public flood control levees. Traditional cast in place concrete or precast concrete panels could also be utilized to provide alternate armoring systems and vary the visual appearance of the system.

Another aspect of the disclosure relates to its minimal weight when compared to traditional methods of constructing berms or raising berms. Traditional methods of raising berms require the addition of structural fill, construction of concrete foundations and wall systems, or the installation of a container to hold a material of sufficient weight to resist the lateral liquid pressures imposed by the retained liquid. This additional weight, in some instances could not be supported by the underlying foundation soils, e.g., the load exceeds the engineered limits of the existing berm. This makes traditional methods impossible to implement. The disclosed structure and method eliminates these weight concerns as the liner material provides the structural capacity required to resist the lateral liquid pressures. The system does not rely on liquid pressure or the weight of the fill material or contained liquid to seal the liner to the existing soil or to other sections of the liner.

BRIEF DESCRIPTION OF THE DRAWINGS

The accompanying drawings, which are incorporated in and constitute a part of the specification, illustrate preferred embodiments of the disclosure. These drawings, together with the general description of the disclosure given above and the detailed description of the preferred embodiments given below, serve to explain the principles of the disclosure.

FIG. 19 illustrates the liner being held in place in an anchor trench 905. Other anchoring methods may be used, e.g., auger anchors attached to the liner and the anchors placed into the soil. A fill material 904 (silt or sand, etc.) can be pumped beneath the liner. The pumped material 904 may be adjacent to the lightweight material. The pumped material is held in place by the liner 903.

FIG. 24 illustrates a conventional earth retention system. An additional benefit of using lightweight fill (constructed in a vertical wall) and liner system (extending over the top of the lightweight fill) is inherit flexibility.

DETAILED DESCRIPTION AND SPECIFIC EMBODIMENTS

It will be appreciated that not all embodiments of the disclosure can be disclosed within the scope of this document and that additional embodiments of the disclosure will become apparent to persons skilled in the technology after reading this disclosure. These additional embodiments are claimed within the scope of this disclosure.

It should be noted that each installation of this system will present unique engineering challenges that will require customization of the system. These may include, but are not limited to, provision of personnel access routes, pipe penetrations, and custom fitting around existing structures. These remedies are outlined in this Disclosure. These challenges are difficult to predict and will vary with the existing conditions and equipment at the individual installation locations. The scope of the Applicant's disclosure is adaptable to each unique engineering challenge by combination of the disclosed systems. The disclosure may utilize rigid foam lightweight fill material (hereinafter "lightweight fill material"). The lightweight fill material typically is fabricated in blocks. In one embodiment, the blocks can be between 42 inches and 48 inches high. In another embodiment, the blocks can also be 42 inches and 48 inches wide and the blocks can be between 8 feet and 12 feet long. Such lightweight fill material can comprise sections of expanded polystyrene (EPS) or a similar lightweight rigid foam plastic material. The material (components or sections) are prefabricated offsite into selected shapes. Each section can be between 6 and 30 feet in length. Other dimensions are possible.

The sections can be variable in height. The lower portion of the section can be broader than the upper section to enhance stability. The sections can be placed end to end on the berm crest. The disclosure may also utilize solid wall hollow lightweight pipe structures. The pipes (hollow tubular structure) may be between 6 and 30 feet. Recognizing that it may be difficult to carry a hollow pipe, the pipe may be fabricated with handles or insert within the pipe wall adapted to allow placement of an installer's hand. These hollow structures may be filled with fill material such as sand. The disclosure may also utilize geotubes place on a berm crest.

Figure 7:
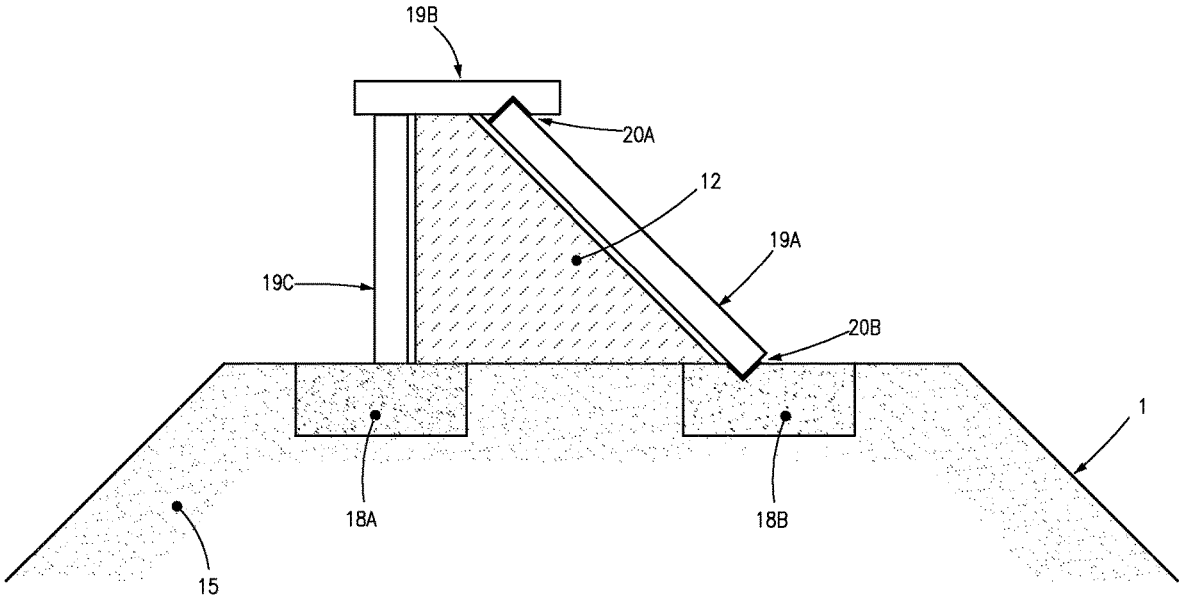
FIG. 7 shows a typical cross section view of Embodiment C, where the armored surface acts as the impervious liner. The armored surface contains the added shaped berm layer. Footers may also be installed to support the armored layer.
Figure 8:
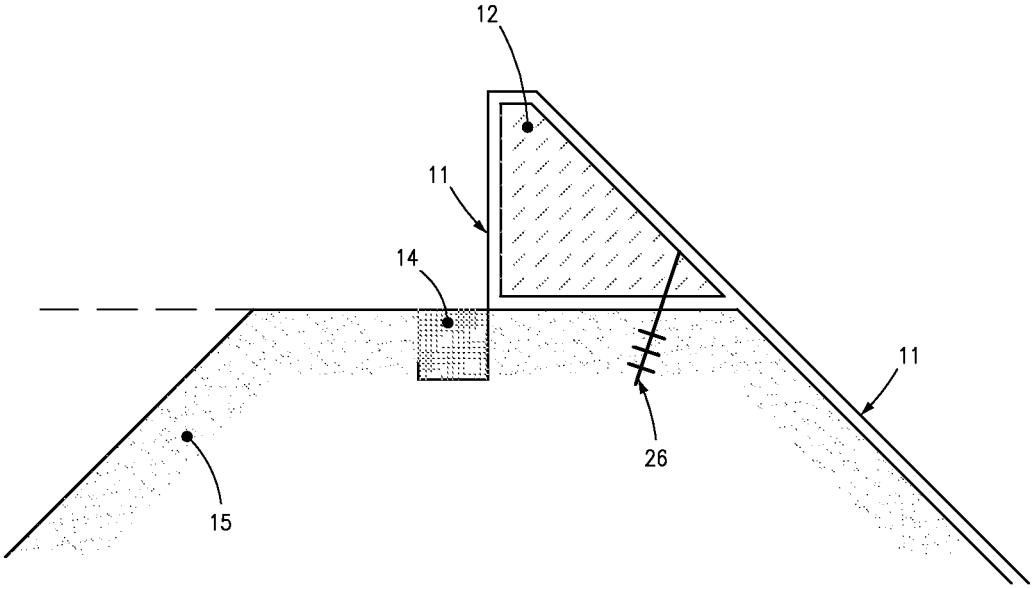
FIG. 8 shows a cross sectional view of Embodiment D of the system in which the impervious liner 11, is extended to the interior of the berm 15 and is continuous with, and acts as the primary liner for the entire pond. Also shown is a mechanical anchor 26 to secure the added berm material to the earthen berm surface.

It will be appreciated that retention ponds do not experience a liquid current. The disclosure, however, is also applicable to levees retaining flowing liquid, e.g. water. A current creates a force parallel with the face of the lightweight fill material, i.e., the surface of the lightweight fill material facing the liquid. A current may also be experienced at the inlet or outfall of a retention pond. In such applications, it may be advantageous to utilize anchors that penetrate the lightweight fill materials and extend into the soil comprising the berm. An example of this is shown in FIG. 8. In another embodiment, FIG. 7 shows a concrete layer in front of the lightweight fill material. In one embodiment, the concrete layer faces only the liquid.

Figure 1:
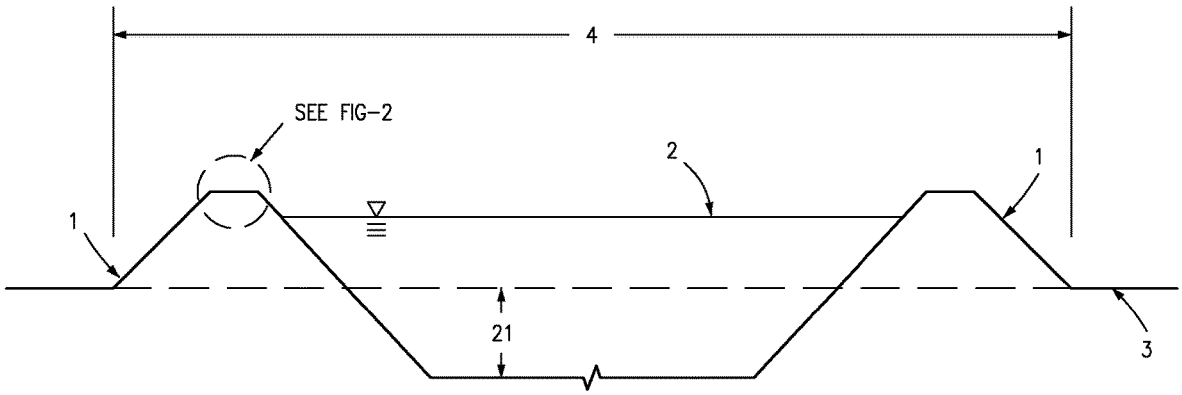
FIG. 1 is a typical cross section of a reservoir constructed by excavating the inner portion of the pond below natural grade and utilizing the excavated material to construct earth embankments. The top of the embankment is shown in FIG. 2.

FIG. 1 is a cross section of an existing reservoir that demonstrates a potential application of the system. This type of reservoir is typically constructed by excavating an area 21, below the existing ground surface of the site. This excavated material may be utilized to construct the berm 1, if it is of suitable geotechnical characteristics, or may be disposed of in another location. The berm 1, may also be constructed of imported fill material of suitable characteristics. The berm height extension structure subject of this disclosure (not shown), can be constructed on berm crest 1A. The berm height extension structure subject of this disclosure (not shown), can be constructed on berm crest 1A. The liquid surface 2, is shown for reference. The liquid surface 2, cannot become higher than the top elevation of berm 1. If liquid surface 2 overtops berm 1, significant damage and potential catastrophic failure of the berm can result. Existing surface grade surrounding the berm 3, is shown for reference. Dimension 4 represents the total footprint of the reservoir formed by the berm. This dimension is often constrained by adjacent structures, utilities, or property lines and thereby preventing the dimension of the reservoir being increased. It is also expensive to construct earthen berms. In a scenario where dimension 4 is constrained, there are limited options to raise the height of berm 1A as the berms have been designed per specific slope stability calculations and an increase of weight caused by adding fill or heavy barriers to the crest of berm to increase the berm height could affect the slope stability or the underlying existing surface 3 to create an unstable geotechnical condition. Therefor lightweight structures or lightweight fill material are desirable. (See also FIG. 4.)

Figure 2:
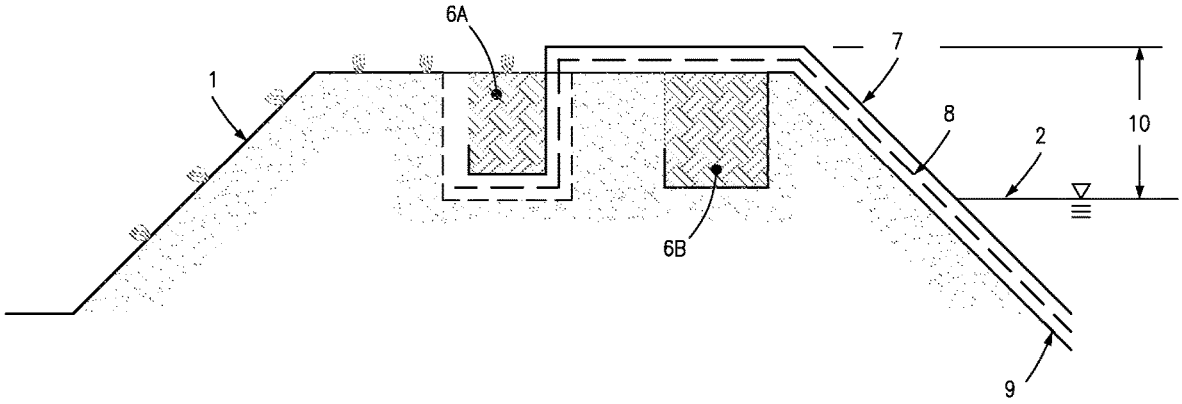
FIG. 2 is a typical cross section of an embankment with two layers of impervious liners (double lined levee). Also shown are two anchor structures for retaining the flexible impervious liners.

FIG. 2 shows a typical cross section of a berm crest that has a double liner system installed 7, 8. The liquid surface 2 is shown for reference. The distance between the liquid surface 2 and the crest of the berm 1A is shown as dimension 10, commonly referred to as freeboard. Freeboard heights are sometimes regulated by government agencies to provide additional storage capacity for extreme rainfall events, system failures, or other events that could quickly increase the elevation of the fluid surface and result in overtopping of the berm 1. In an embodiment, the lightweight fill material subject 12 shown in FIG. 3 of this disclosure (positioned on top of the berm 1A) may comprise the required freeboard.

Figure 3:
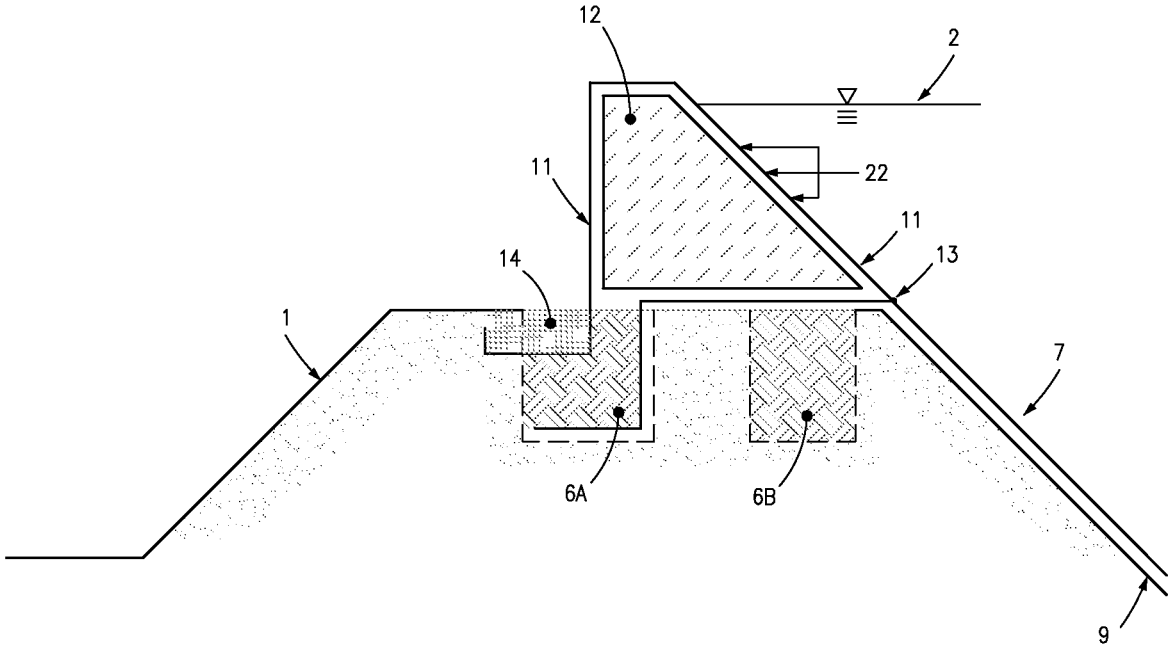
FIG. 3 shows a cross sectional view of Embodiment A of the disclosure where the new impervious liner is joined to an existing liner. A former anchor is illustrated with two additional anchors. The anchors may be trenches dug in the top of the ground berm and filled with additional earth, gravel or concrete.

The double liner is typically installed in instances where little or no leakage of the liquid is desired or permitted by law. The double liner consists of a Primary Liner, 7 that is the primary impervious layer in the system. Liner 7 is typically terminated in an anchor trench 6A, placed along the berm crest. The anchor trenches 6A and 6B are engineered to provide adequate soil mass 61 to prevent pullout or displacement of the respective liners 11 and 9 and can also anchor the drainage layer 62. Such engineered structures are illustrated in the Figures of this Application. The Primary Liner 7 may be the top liner of the double liner system. FIG. 3 illustrates an embodiment where the liner 7 (which may extend to the bottom of liquid retention basin) is attached to liner 11 at a seam 13 on the interior side of the berm. (It will be appreciated that the term "interior slope" or "interior berm" pertains to the side of the berm directly adjacent to the liquid in the retention pond. The "exterior berm" or "exterior slope" pertains to the opposite side of the berm relative to the retention pond.) Two anchor trenches 6A and 6B are shown. One anchor trench 6B may be used to secure the Secondary Liner 9. The anchor trench stabilizes the liner against displacement and is typically backfilled with compacted soil 61. Secondary Liner 9, provides a backup impervious liner and enables installation of leak detections systems to determine the quantity of leakage through the primary liner. A drainage layer/leak detection apparatus 62, is typically installed between liners 11 & 9 to cushion and protect the primary liner and to provide means for leakage through the primary liner to be directed and collected in a leak detection system. The drainage layer can be constructed of a sand layer or a synthetic material such as a geonet. It may also comprise a perforated pipe to allow the inflow of liquids 62.

Liners 7 & 9 are typically constructed of High Density Polypropylene (HDPE), Low Density Polypropylene (LDPE), Polyvinyl Chloride (PVC), poly urea composites, or polyethylene. They are installed to form a continuous liner in the reservoir.

This double liner system presents challenges to any attempt to raise the height of the existing levee as the integrity of the anchor trenches and liners must be preserved to maintain the system.

FIG. 3 shows Embodiment A of the proposed system. The drainage layer mechanism 62 is shown at the bottom the backfill 61 of the anchor trench. A new anchor trench 14, is shown along the exterior edge of the proposed system. The new anchor trench is installed along the existing berm crest A1 in a manner that does not disturb (or minimally disturbs) the existing anchor trench, 6A. There is a second anchor trench 6B capable to holding or securing an impervious liner. A lightweight fill material 12, is shown placed along the berm crest. This lightweight fill material forms the structural core of the extended berm height system 12. The lightweight fill material is typically installed in lengths that are 8-10 feet long (sections) and do not require direct attachment to each other. The lightweight fill material may be constructed of a foam type material as described previously. The foam may be rigid. A new liner 11, partially encloses the lightweight fill material 12, and is attached to the impervious liner 11 anchored to the existing liner 7, by mechanical bonding, welding, adhesives or mechanical fastening at point 13. The attachment must provide sufficient strength to join the two liners and the joined liners have sufficient liner strength to secure the position of the lightweight fill material. The attachment must also be liquid impervious to maintain the integrity of the liner system. The combination of liner 7, and the attachment point 13, and anchor trench 14, form the structural anchor system that enables the lightweight fill to adequately resist the liquid pressure 22, which results from the liquid elevation 2 acting upon the structure. Items 7, 13, and 14 (liner, liner attachment point, and anchor trench) also form the means of joining the system into a continuous structure. The system eliminates the need for directly connecting the lightweight fill material sections. This method does not disturb the secondary liner 9 or its anchor trench 6B.

Figure 4:
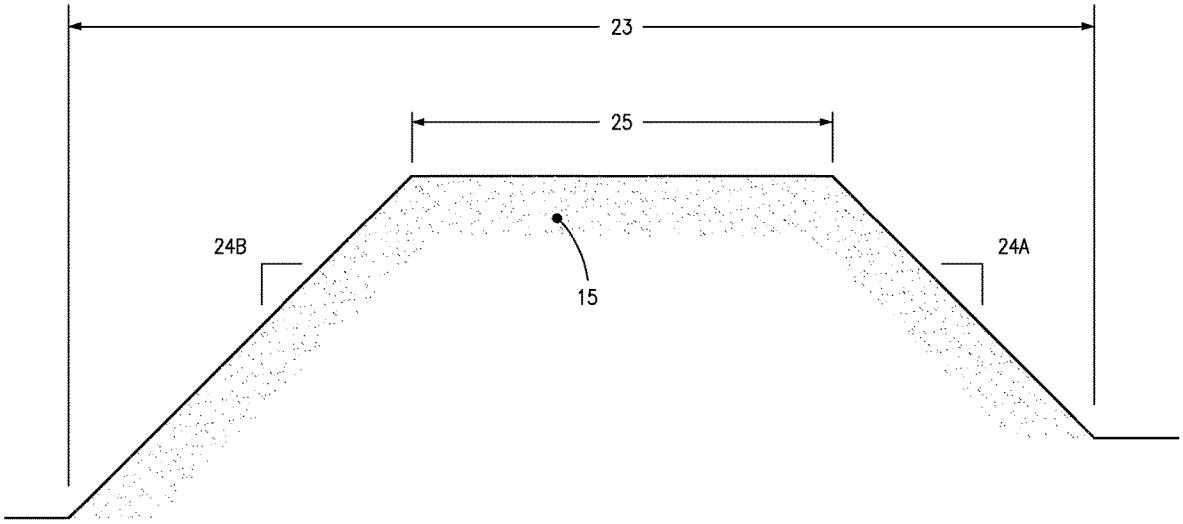
FIG. 4 shows a typical cross section of an existing earthen levee (berm) constructed of compacted soil material.

FIG. 4 shows a cross section of a typical earthen berm 1. No berm height extension is illustrated. Illustrated is the crest of the berm 1A (constituting the highest point of the berm). Berms are commonly constructed of compacted earth fill 15. The compacted earth fill is of suitable geotechnical characteristics to contain the fluid and maintain the structural integrity of the berm against hydrostatic pressures. These berms may be constrained by the underlying foundation soils. There may be instances where the bearing capacity of the foundation soils limits the weight (and therefore the height) of the levee to be constructed on top of the foundation soils. The height can also be constrained by the available footprint of the berm, shown as dimension 23. The interior slope 24A and exterior slopes 24B of the berm, are limited in their degree of steepness by the soil characteristics of the earth fill 15. It will be appreciated that the term "interior slope" or "interior berm" pertains to the side of the berm directly adjacent to the liquid in the retention pond. The "exterior berm" or "exterior slope" pertains to the opposite side of the berm relative to the retention pond. This slope limits the height within the footprint 23. The width of the berm crest 25, is typically limited to how narrow it can be due to constructability of the berm itself as related to equipment access during construction. The berm crest may also facilitate installation of equipment, roadways, pedestrian paths, or routes for inspection of the berm.

Figure 5:
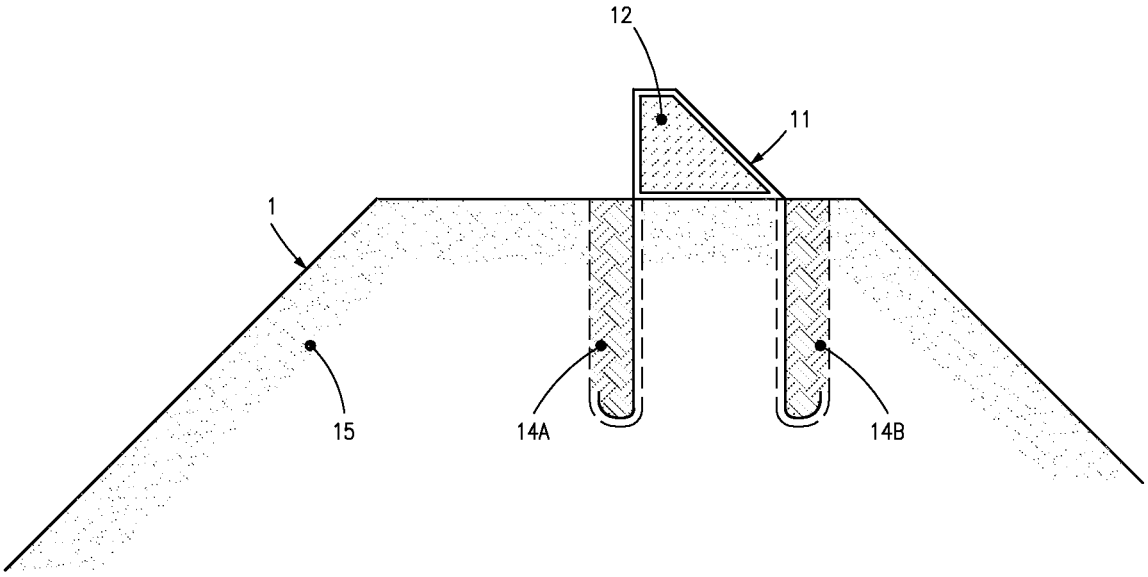
FIG. 5 shows a cross sectional view of Embodiment B of the disclosure where the new impervious liner is anchored into existing soil. In this embodiment, the liner may be buried in one or more trenches dug in the top of the earthen berm.

FIG. 5 shows Embodiment B of the disclosure. In this version, the new anchor trenches 14A and 14B, are utilized to anchor the impervious liner, 11. The anchor trench can be backfilled with existing soil 15 of the berm. In other embodiments other soil may be brought into the site and used to compact and anchor the liner within the anchor trench. Note that this existing soil (compacted earth fill 15) may be part of an existing berm 1 or could be natural grade in instances where a berm does not exist. The lightweight fill material 12, forms the structural core of the system while the liner 11, and anchor trenches 14 form the system that anchors the system, i.e., the lightweight fill material, and provides the impervious nature of the system. This embodiment could provide economical means of effectively raising the height 63 of an existing berm 1 (see FIG. 3), or facilitate the construction of a levee where none existed previously. This embodiment is unique in that it does not require an existing impervious liner to be present. In this embodiment, the liner could be, but is not limited to the materials discussed above such as HDPE, LDPE, PVC, poly urea, or polyethylene. In one embodiment, the impervious liner has tensile strength of 168 pounds per inch and puncture resistance of 90 lbs.

Figure 6:
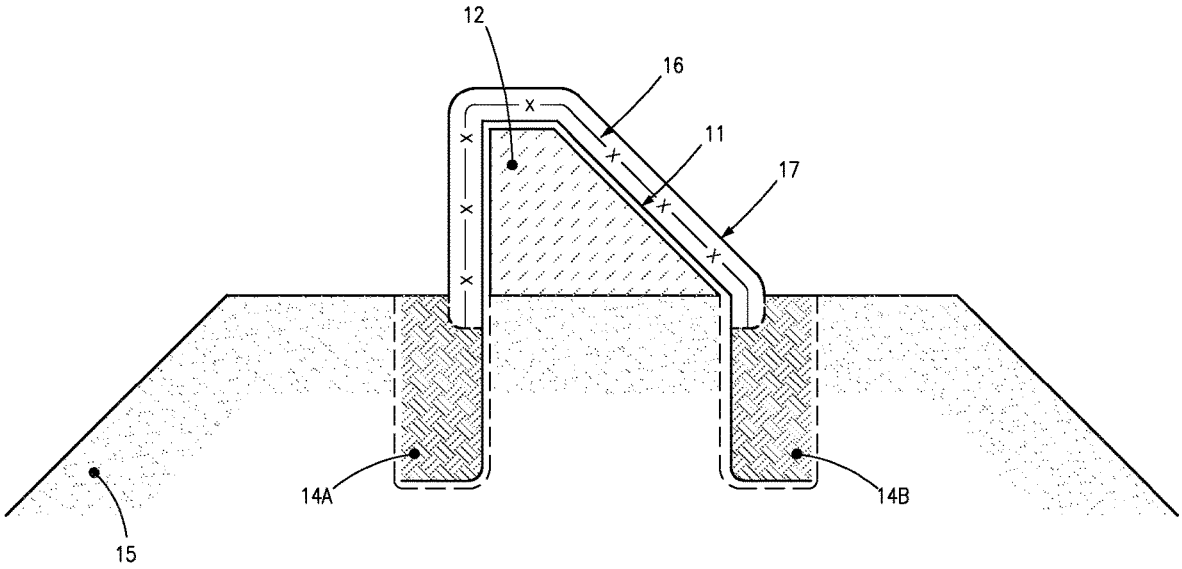
FIG. 6 shows a typical cross section of Embodiment B, with the addition of an armored surface composed of concrete placed over the added berm material.

FIG. 6 shows a version of Embodiment B with the addition of an armored facing (protective structure 17). The protective structure may be concrete. This version would be desirable for use in areas where protection against liquid flow, vandalism, impact, or UV degradation of the liner material was desirable. In this version, the anchor trenches 14A and 14B, lightweight fill material 12, and impervious liner 11, are installed in the same manner as above. A protective structure 17 could be installed by placement of reinforcing steel 16 (Welded Wire Fabric or Rebar) along the liner 11. Concrete could then be placed over the liner and enclosing the reinforcing by means of shotcrete placement, where concrete is sprayed onto a structure. Shotcrete is, in effect, a version of a cast-in-place concrete wall. Rather than placing concrete into forms, however, a fresh mix is sprayed onto wall panels that have been erected in the shape of the structure. Concrete is applied from a pressurized hose (hydraulic spraying) to encompass the reinforcement and build up the wall thickness, forming structural shapes that include structural shape or assemblies. These can be constructed over the lightweight fill material. Polystyrene is a common surface for accepting fresh concrete. This method of concrete placement is well known in the industry, and is only one example of how concrete could be placed for protection of the system. The concrete structure 17, would ideally extend below the grade of the berm crest 1A to provide additional protection. The concrete materials may be joined by sealing material.

FIG. 7 shows Embodiment C of the system in which the protective structures 19A, 19B, and 19C would be installed in sections and joined or sealed together at the joints 20A, 20B with sealant to form the impervious liner. Sealing materials may include sealing adhesives such as polyurethane, acrylic latex, silicon, or other commercially available joint sealants. The specific sealant or sealing adhesive could be selected based on the specific design requirements and configuration of the panel materials utilized. Sealants would typically conform to ASTM C920—Standard Specification for Elastomeric Joint Sealants. This method demonstrates the use of an alternate material to anchor the lightweight fill material and provide the impermeable liner. As it would require the installation of foundations 18A and 18B, and either the use of prefabrication of the armor panels 19A-19C or the utilization of cast in place concrete. In this embodiment, the protective armor could feasibly be any material that would be of impervious nature, of sufficient structural strength and mass, and incorporate the ability to be joined together to create impervious joints. In another embodiment, the barrier material could be lightweight foam material or lightweight fill material. The ends of each block of lightweight foam material may be configured wherein the end of a first block would interface in a locking pattern into the end of the second adjoining block. These interlocking ends would support the liner in retaining liquid. Further, the interlocking ends could be used with a liquid impervious sealing material. In other embodiments, mechanical clips or clamps may be used to hold the adjoin blocks in place.

FIG. 8 shows Embodiment D of the berm system in which the impervious liner 11, is extended from the base of the retention pond to the interior of the berm and is continuous with, and acts as the primary liner for the entire pond. This embodiment would be typical of using the system in a newly constructed pond, without the need to bond or join the liner 11 to an existing liner 7, as shown in FIG. 3. In this embodiment, the addition of a mechanical anchor 26, would be desirable to anchor the lightweight fill material 12, in instances where the reservoir was empty and the liner would have no horizontal liquid pressure pushing the berm system toward the exterior side of the berm or pressing the liner to provide a force to pull the berm system into the interior side of the berm.

Figure 9:
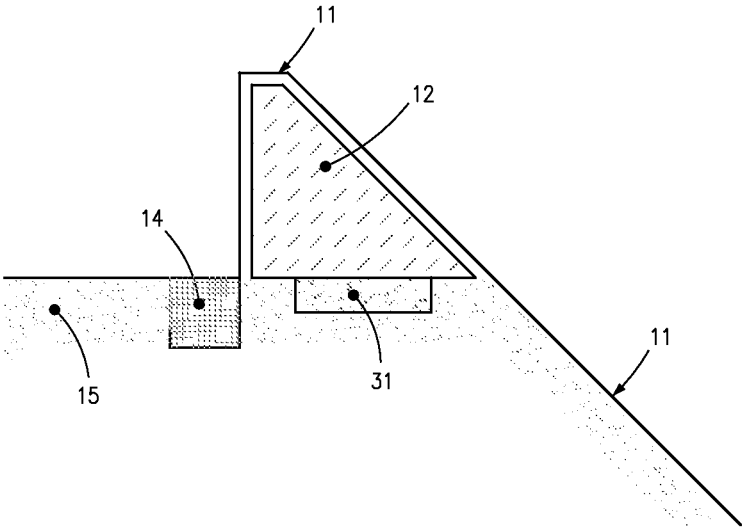
FIG. 9 shows the cross sectional view of lightweight fill material 12 bonded to a concrete foundation 31 as a means of anchoring the system (added berm material and imperious liner 11) against lateral movement towards the interior (liquid side of the berm surface).

As an alternate to the mechanical anchor, the foam could be bonded adhesively or mechanically to a concrete foundation or other rigid material 31 as a means of anchoring the system against movement towards the interior side of the berm. This detail is shown in FIG. 9. Using adhesive or mechanical bonding, the rigid material 31, would bond to the bottom of the lightweight fill material at the juncture 54 of rigid material and the lightweight fill material. This bonding would prevent movement towards the pond interior 55 as a result of an external force such as wind or impact. This configuration would also provide additional resistance to overturning due to the weight of the rigid material. The rigid material could be buried and mechanically anchored to the lightweight fill.

Figure 12:
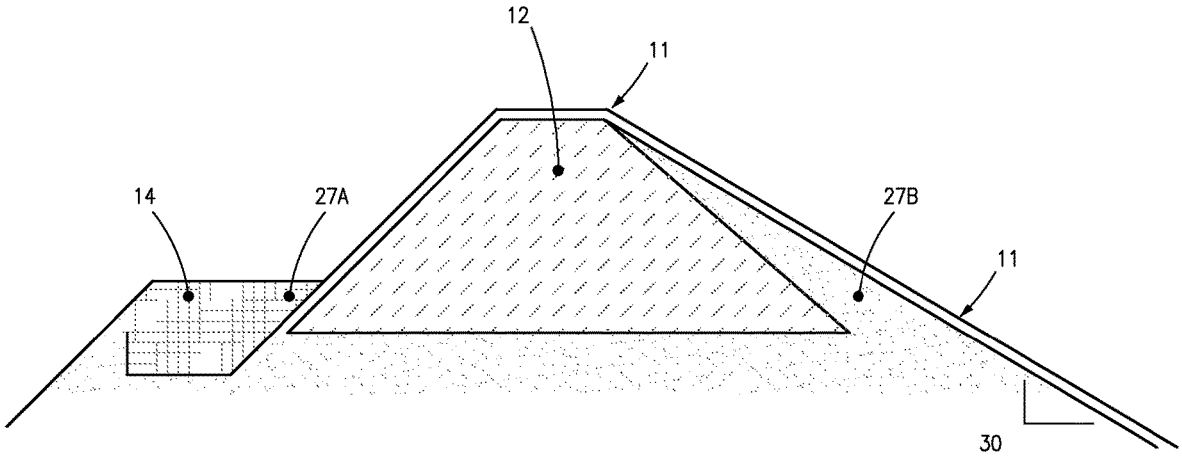
FIG. 12 illustrates a cross sectional view of an embodiment wherein the lightweight fill material 12 is anchored by soil or other fill material 27A, 27B on both sides of the structure. Also the slope of the berm 30 is extended at least a portion of the material structure. An anchor structure 14 is also shown on the backside (non liquid side) of the berm.

FIG. 12 shows a further embodiment of FIGS. 8 and 9, (Embodiment D) wherein an arrangement with a soil anchor material 27A, 27B is placed on both sides of the lightweight fill material 12. This detail shows the soil extending along the face of the lightweight fill to anchor the lightweight fill and to provide a continuous interior slope 30, against which is placed the impervious liner 11. This arrangement may be desirable to better anchor the lightweight fill in Embodiment D (FIG. 8) of the system. Looking at FIG. 8, the soil anchor point 26, could optionally be installed on one side only, and the cross section and shape of the soil anchor 26 and the anchor trench 14 could vary according to the unique properties of each installation.

Figure 13:
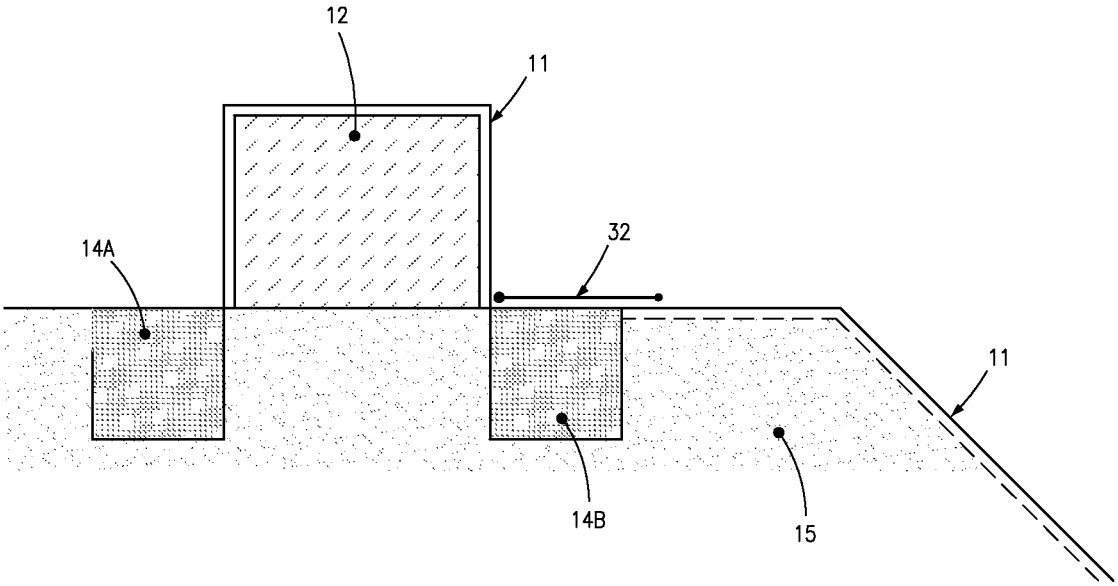
FIG. 13 illustrates a cross sectional view of an embodiment where the lightweight fill material 12 is anchored by the impervious liner 11 and the liner is anchored by a trench 14A, 14B constructed on both sides of the lightweight fill material structure.

FIG. 13 shows another arrangement of Embodiment D that is illustrated in FIG. 8. FIG. 13 contains an anchor trench 14A and 14B, that are installed on both sides of the lightweight fill material, 12. This arrangement would fully anchor the lightweight fill against lateral movement. It would also provide the benefit of two traditional anchor trenches for the impervious liner 11. The impervious liner is illustrated as extending from the liquid retention pond. The impervious liner also extends into a first anchor trench 14B, over the lightweight fill material 12 and into the second anchor trench 14A. This may be desirable in instances where the forces exerted by the liner (due to thermal expansion/contraction) may be greater than the resistance available by the lightweight fill 12, and the previously mentioned mechanical anchors, 26 as shown is FIG. 12. An anchor trench cover 32 may be desirable to prevent erosion and saturation of the interior anchor trench 14B by the contained liquid. This may impair the retention strength of the anchor trench. The anchor trench cover 32 could be constructed from the same material as the liner 11 and attached by mechanical, welding, or adhesive means to the liner 11. The anchor trench cover 32 could be an alternate type of liner or a thinner section of liner, as it will likely not function as a structural member, i.e., it will not be tautly positioned over the lightweight fill material. In some applications, an anchor trench cover can be placed over second exterior anchor trench 14A In another embodiment illustrated in FIG. 14, the system may be installed on an interior berm. An interior berm is defined as a berm with contained liquids on each side, as would be the case in a berm dividing a larger basin into two separate basins. This situation could present a situation that would require bonding of the new liner 33 to an existing liner 11 on each side of the lightweight fill 12 and introduce unique structural load situations or constructability requirements. One alternative in this situation is to install the primary liner 11 embedded into anchor trenches 14A and 14B in order to provide structural integrity to the system. The anchor trenches could be filled with soil material 6A, 6*b* from the berm 15. The new containment liner 33, would then be bonded (adhesively or mechanically) to the existing liner 11, on either side of the system. This liner 33, could also be bonded to the liner 11 in order to provide additional strength and prevent liner movement in the wind. The liner is shown extending from a first bonding juncture with liner 11 and at a second juncture with liner 11 on the opposite side of the berm extension composed of lightweight fill materials 12. The new anchor trenches 14A and 14B may need to be constructed in a way to minimally disturb existing anchor trenches (not shown). Liner 11 can be held at the anchor trenches 6A and 6B.

Figure 10:
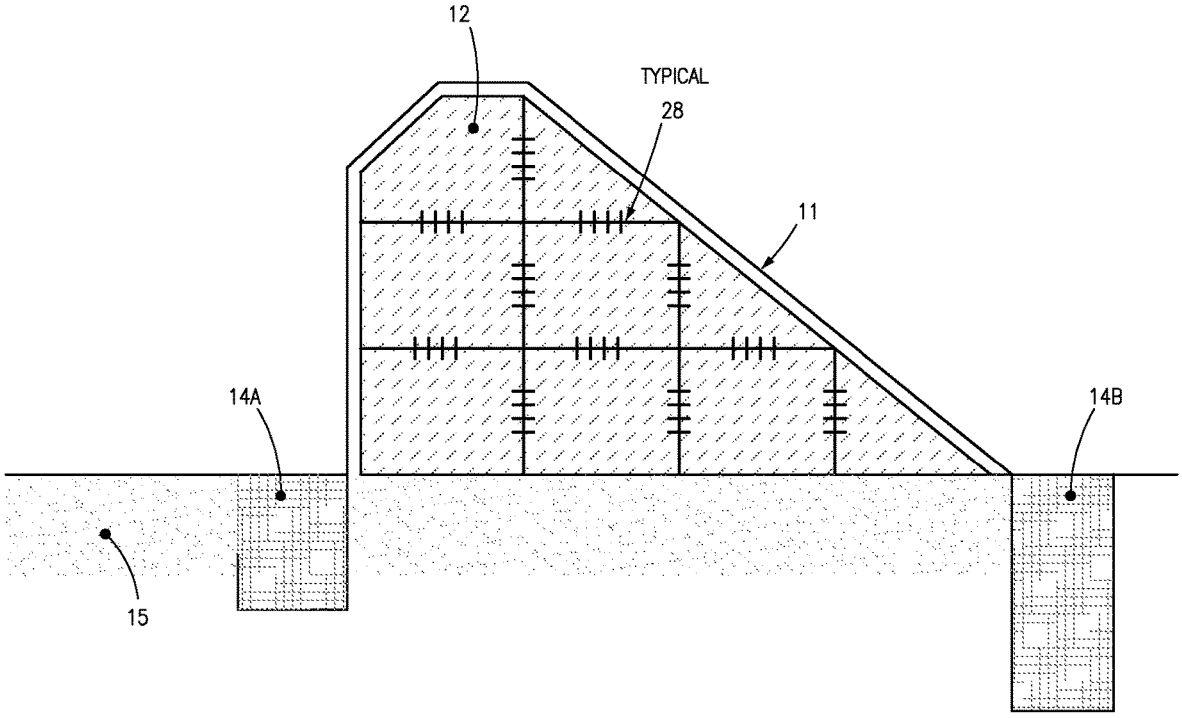
FIG. 10 shows a cross sectional view of Embodiment E of the system that incorporates a multitude of individual lightweight fill blocks 12 to form a singular larger block. The embodiment shows multiple mechanical anchors 28 assisting in securing the fill blocks together. Trenches 14A, 14B are shown for anchoring the impervious liner.

FIG. 10 shows Embodiment E of the system 1B that incorporates a multitude of block sections 12 comprised of individual lightweight fill material to form a singular larger block 56. The individual blocks 12, would be joined via mechanical anchors 28, which are commercially available and typical to the installation of multiple layers of lightweight fill material blocks. The height 63 of this system would be limited by the strength of the liner material 11, the strength of the anchor trenches 14A and 14B, and potentially the strength of the lightweight fill material. This embodiment could also be utilized as in FIG. 3, where the liner 11 is connected to an existing liner 7, or as shown in FIG. 8 where the system 1B is utilized with a continuous liner 11. The downward force applied by the liner material will act to compress the blocks together and cause them to act as a singular block in conjunction with the mechanical anchors. The downward force will be increased if the liner is taut (under tension) as it extends across the lightweight fill material. As an alternative to the mechanical anchors 28, the blocks 12 could be joined together with a compatible adhesive. This adhesive would cause the individual blocks to act as a singular block. In another embodiment, (not shown) the individual block sections could be over lapped across the lower joints of two separate sections, thereby increasing the structural unity of the length of multiple block sections comprising the lightweight fill material.

Embodiment A (FIG. 3) could be constructed to allow the addition of a leak collection and detection system in between the existing primary liner 7 and the new liner 11. This could be required to satisfy certain regulatory requirements or provide a means of monitoring the integrity of the attachment point 13. A leak detection system 62 could be provided for any of the embodiments. A leak detection system is traditionally constructed of perforated pipe (typically PVC or HDPE) installed to collect any liquid that leaks from the containment system, in this case, through liner 11 or attachment point 13. The collected liquid is routed to a collection sump where it can be monitored or pumped back into the containment area.

Embodiment A could also be constructed by adding a second impervious liner (not shown) over the existing liner 11 and providing an additional attachment point to the existing liner and an installing the second liner into the anchor trench 14.

Embodiment E or B (FIG. 10 or 5) could be constructed also with the addition of a second impervious liner over liner 11 and the addition of a new anchor trench on each side of the system 1A. This would provide a secondary liner and provide additional safety factor into the strength of the system against overturning.

Figure 11:
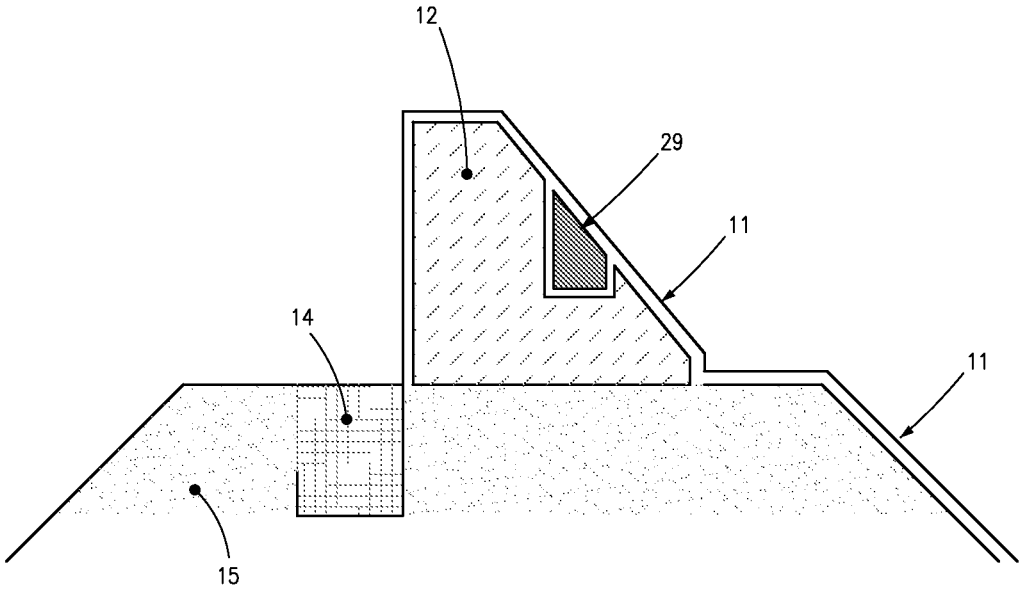
FIG. 11 illustrates a cross sectional view of an embodiment wherein the lightweight fill material 12 is supplemented with a preformed higher density mass 29 that fits within an indentation of the fill material structure. The higher density mass may extend across a plurality of lightweight material sections.

FIG. 11 shows Embodiment F of the system 1B that incorporates a high mass insert to provide additional resistance to horizontal displacement and overturning of the system. The system is position on the berm crest 1A at the top of the berm 1. In this embodiment the weight of the lightweight fill material structure is supplemented by the addition of more dense material. The high mass insert 29, could be constructed of any material of sufficient density to provide the required resistance to displacement or overturning. This supplemental mass can be concrete poured and cured in a mold wherein the shape of the mold is complementary to an indentation formed within the structure of the lightweight fill material. Materials such as sand bags, geotubes, and steel shapes, would be examples of materials also available. It will be appreciated that the lightweight fill material is transported and positioned at the berm crest 1A without the supplemental weight (higher density material). The weight can be added after the structure is in position. In one embodiment, the weight may be less than 100 lbs. and manually positioned into the structure. It will be appreciated that a structure can have multiple indentations to receive the supplemental weight. The advantage of this system will be to allow the structure to have increased mass without requiring mechanical equipment, e.g., mechanical lifting equipment or carrying equipment, to be brought to the site. (The supplemental weight may be manually placed within the structure.) It will be appreciated that access to the site of the berm may be restricted. Illustrated are the lightweight fill material structure 12 and the supplemental weight 29 fitting into an indenture of the fill structure. The high mass insert 29, could be anchored or bonded to the lightweight fill material 12. Also illustrated is the anchoring trench 14 containing the end of the liner 11 that is placed over the fill structure and continues to cover the inner surface of the berm 1.

In another embodiment, the lightweight fill sections can be joined together end to end. This is particularly useful when the lightweight fill material comprise sections of expanded polystyrene (EPS) or a similar lightweight rigid foam plastic material. The lightweight fill material (components or sections) are prefabricated offsite into selected shapes. Each section can be between 6 and 30 feet in length. Other dimensions are possible. The sections can be variable in height. The lower portion of the section can be broader than the upper section to enhance stability. The sections can be placed end to end on the berm crest.

The ends of the lightweight fill material sections can be joined together. This can be accomplished by inserting rebar into each end or using commercially available anchors as in Embodiment E. In one embodiment, the length of rebar inserted into each section can be 4 to 24 inches. The rebar can be precut, thereby facilitating prompt assembly in the field. Each juncture can be linked together by multiple sections of rebar. It will be appreciated that the linking together of each component will prevent one component or section of lightweight fill material from being pushed out of line, causing a gap to form in the extended height berm subject of this disclosure. The rebar can be fitted into indentations or holes within section ends of the lightweight fill material. It will be appreciated that the length of the rebar section, preferably greater than 20 inches, will improve the stability of the junction between two sections of the lightweight fill material. The greater unified length of the lightweight fill sections will protect against a localized surge in liquid level and help to facilitate construction by anchoring the lightweight fill material sections together prior to anchoring them by enclosing them with the liner 11. Multiple lightweight fill sections could also be joined together using continuous steel cables inserted lengthwise through preformed penetrations in each section of the lightweight fill material. This steel cable could be mechanically anchored to the existing berm to provide additional structural stability. The cable diameter, material of construction and spacing of the mechanical anchors would depend on the specific design parameter of each installation.

In another embodiment, the ends of each lightweight fill material are modified in the manufacturing process to create male and female protrusions and indentations at each end. Therefore one end of the lightweight fill component would contain a male protrusion and the other end would contain a female indentation. The indentations and protrusions would be complementary dimensioned to allow the male end of a first component to fit into the female end of a second component. As with the joining the ends with rebar, the joined sections of lightweight fill material would prevent one section from being pushed back toward the exterior side of the berm. In both cases (rebar linkage or male/female end coupling), the series of lightweight fill material would act as a unified structure or barrier. This structure of ends of the lightweight fill structure can also be attached together by sealing adhesives such as polyurethane, acrylic latex, silicon, or other commercially available joint sealants. The specific sealant or sealing adhesive could be selected based on the specific design requirements and configuration of the panel materials utilized. Sealants would typically conform to ASTM C920—Standard Specification for Elastomeric Joint Sealants. Alternatively, mechanical components such as but not limited to clips, screws, clamps or self contained bracket and bracket holders could be used.

In another embodiment the lightweight fill materials completely surround a retention pond. Therefore the ends of each section of lightweight fill material abut the end of another section. In another embodiment where the lightweight fill material forms a levee structure, the series of sections of lightweight fill material may end where the ground level exceeds a specified elevation. The end section may be dug into the ground at the point that the ground level exceeds the specified elevation. This would serve to anchor the end of the section linked in accordance with FIG. 1.

In another embodiment of the invention, the height of a liquid retention pond may be elevated by placement of lightweight structures on top of an existing berm. The structures can be solid wall with hollow internal structures. It will be appreciated that this structure is different from the rigid lightweight foam structures discussed above. This embodiment utilizing solid walls with hollow internal structures can allow utilization of pre-existing material. For example hollow plastic pipes can be used. For example, this could be 36 inch diameter HDPE pipe. The ends of the pipe ends can be joined together to form a multi-section liquid impenetrable barrier. The barrier can extend the entire length of the berm. It is envisioned that the pipe could have a diameter of between 6 inches to 60 inches. In one embodiment, the interior structure may contain structural reinforcement members. For example a structural component could be placed to extend horizontally across the diameter of the pipe.

Figure 15:
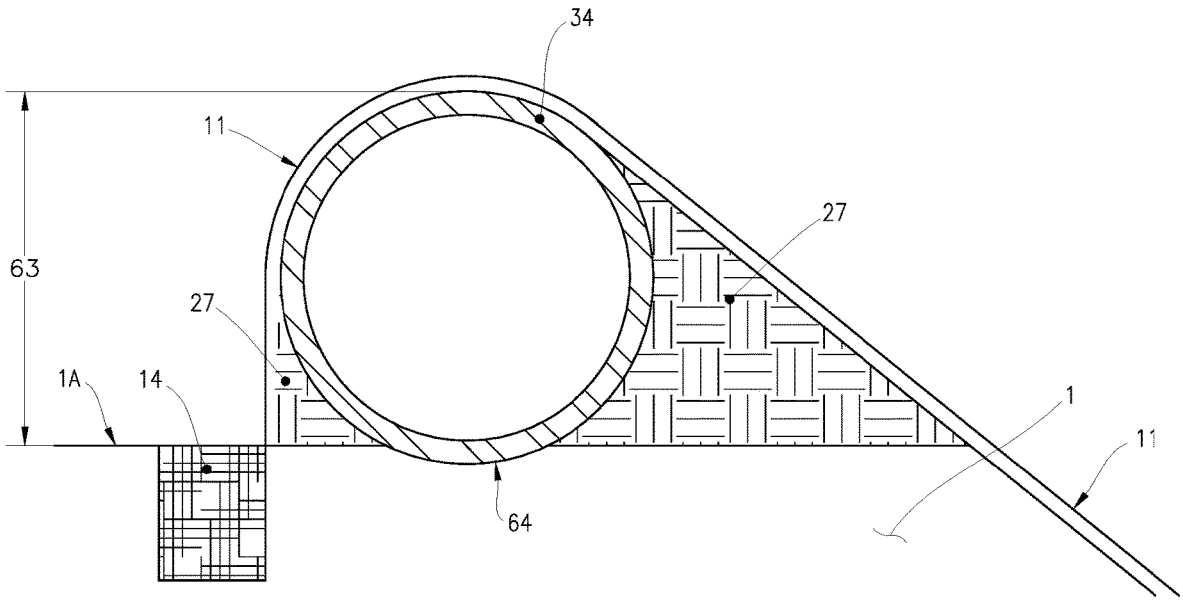
FIG. 15 illustrates a side view of a curved solid wall hollow structure 34, e.g., a pipe, placed on the top of the berm 15. The circular cross section of the pipe structure 51 another is used to elevate the height of the berm. A shallow trench 52 may be excavated along the top of the berm. The curved exterior surface of the pipe 34 can be placed into the trench, thereby holding the pipe laterally in position. This can facilitate holding the pipe in position at the top of the berm against possible lateral force of the elevated liquid. Supplementing this is the fill material 27 positioned against the front and backsides of the pipe. Also shown is the use of the extended retainer liner 11 to hold the pipe in position. The liner can be tautly held to press the pipe downward. An end of the liner is anchored by placement in a trench 14.

Looking at FIG. 15, the liquid impenetrable properties of the HDPE pipe 34 can be enhanced by also using the liquid impenetrable properties of the berm liner 11. The liner extends from the bottom of the pond up the slope of the berm. The liner 11 continues over the top surface of the pipe structural element 34. The liner is buried within fill material (anchor trench) 14 at the top of the berm. The liner is taut, thereby holding the pipe element down against the surface of the berm.

Figure 14:
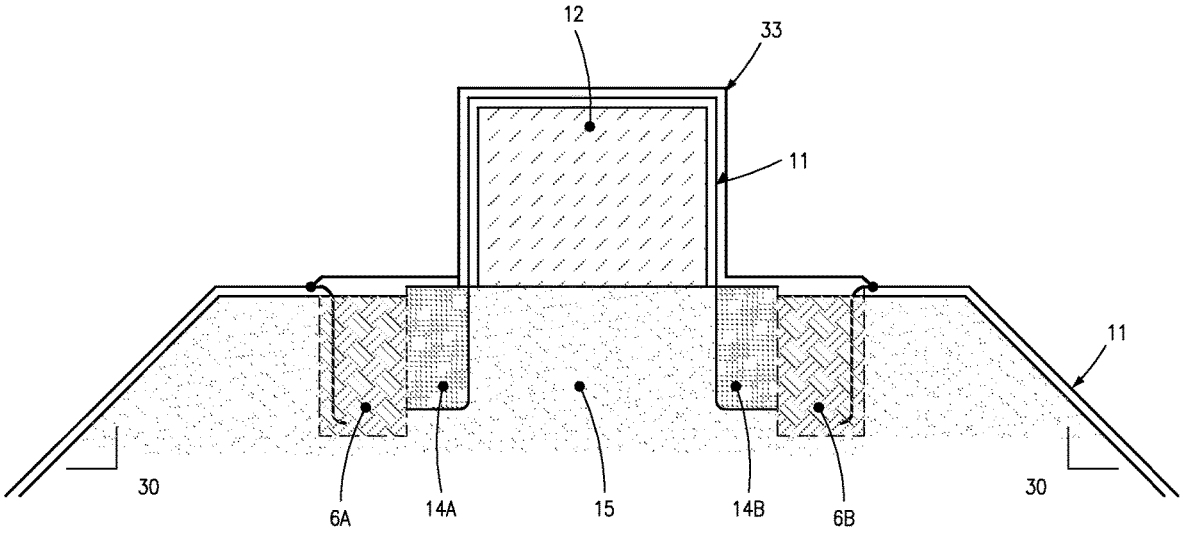
FIG. 14 illustrates a cross section of an interior berm, i.e., a berm with contained liquids on each side. Elevation of this structure requires bonding 99 of the new liner to an existing liner on each side of the lightweight fill and introduces unique structural load situations or constructability requirements. In this embodiment a double layers of a fluid impervious liner 33, 11 may be used with the inner anchor 14A, 14B in a trench dug in the top of the berm surface and the outer liner layer 6A, 6B covering the trench surface.

FIG. 15 also illustrates the Applicant's Embodiment G of the system in which the previously described lightweight fill material 12 is replaced with a hollow structural element 34. See FIG. 14 illustrating the position of the lightweight fill material. The structural element illustrated in FIG. 15 could be of any shape, but commonly available circular shapes would be the most common, for example, pipe made of PVC, HDPE, steel, or concrete. The pipe is selected for its lightweight relative to its structural strength. The lightweight will facilitate workers moving the pipe to a location on a narrow berm crest that may be non accessible by construction equipment. In one embodiment, the lightweight structure may contain handhold indentures adapted to facilitate carrying. The structural element has rigid sides. The circular shape of the hollow structural element 34 provides the significant strength, especially against the horizontal force created by liquid extending of the berm crest 1A. The shape of the structure defines the height 63 added to the berm crest 1A. The structure may be positioned in a trench 64 created in the berm crest 1A. This structure will facilitate holding the structure from horizontal movement. The solid section of the structural element would have a density greater than 5 pounds per cubic foot, a compressive strength greater than 1000 psi, and a flexural strength greater than 20 psi. Accordingly, in some embodiments, the material selection may result in an overall cross section density of the element of less than 62 pounds per cubic foot (buoyant in water). Since the overall cross sectional density of the element is less than the density of the retained liquid, the structural element would not be stable against lateral pressure forces from the retained liquid and the structural element would be buoyant—it would float. As in the previous embodiments, i.e., FIGS. 3, 5, 6, 8, 10, and 11, the structural fill would be anchored against buoyant and lateral forces by the impervious liner 11 stretched (taut) over the lightweight fill materials In the embodiment of FIG. 15, a soil anchor point 27 is utilized to further secure the structural element 34. The liner 11 is secured in an anchor trench 14.

The hollow structural element has a fixed shape and forms like the lightweight fill material, and is not filled with soil or material of similar density to be secured against lateral and buoyant forces.

Figure 16:
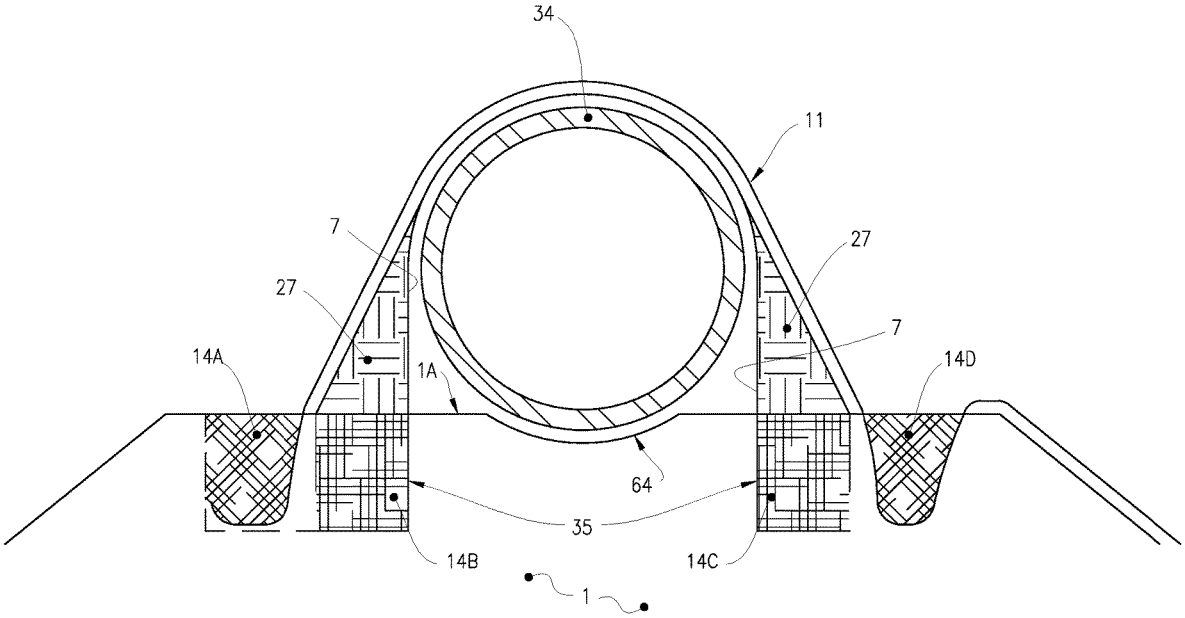
FIG. 16 illustrates a side view of a solid curved wall hollow structure 34, e.g., a pipe placed on the top of the berm. Illustrated is an optional trench to hold the pipe in position on the berm. Also illustrated is the liner 11 extending over the top of the pipe. The liner may be under tension (tautly pulled over the top surface of the pipe) and therefor the liner operates as a structural component to hold the pipe in a fixed position against the lateral force of the liquid.

FIG. 16 illustrates another embodiment for extending the height of a berm retention pond. This embodiment is disclosed in least in part in FIG. 15 above. FIG. 16 illustrates a cross sectional view of a berm 1 and a light weight extension or structural material 34. In this instance, the extension material may be a pipe positioned horizontally parallel to the height of the top of the berm 1A. The circular structure of the pipe achieves significant strength to the structure. This strength may be of importance for the barrier (berm height extension) withstanding lateral force of liquid rising above the earthen berm. The circular shape has greater strength than other shapes such as rectangles or squares. The lightweight height extension material can be a plurality of solid wall hollow structures. The solid wall hollow structures may be positioned end to end continuously and liquid tight pipe connections extending along the top of the berm. These structures can be installed upon the top or crest of a berm. These structures may be anchored to the berm structure. The anchoring mechanisms may be screw augers. The anchors may also comprise the end of a liner material 11. The liner material may be secured in an anchor trench 14A, 14D. In one embodiment, the liner may be an extension of the liner that covers the bottom and sidewalls of the retention pond. The liner 11 may be extended so that it covers the solid wall hollow structure 34. The liner 11 may be tautly placed over the solid wall hollow structure 34. Stated differently, the liner is held under tension over the sold wall hollow structure. The liner is a structural material holding the sold wall hollow structure in a designated position. The liquid impermeable solid wall structure is held in place by the liner. Preferably the liner is taut. The liner is held in place using placement of the liner within an excavated portion of the berm, i.e., anchor trench, and backfilling material 14A, 14D over the liner. The embodiment illustrated in FIG. 16 also shows the use of fill material 27 placed on each side of the piped apparatus to hold the apparatus in a lateral position. This strengthens the positioning of the pipe section against lateral movement of the liquid over the berm. The structure may be further supported by placement of a separate liner 7. The liner is placed over the solid wall structure. The liner is secured in the anchor trench 14B, 14C.

FIG. 16 illustrates an embodiment of the system in which the previously described lightweight fill material 12 is replaced with a solid wall hollow structural element 34. This structural element could be of any shape, but commonly available circular shapes would be the most common, for example, pipe made of PVC, HDPE, steel, or concrete. The solid wall section of the structural element 34 would have a density greater than 5 pounds per cubic foot, a compressive strength greater than 1000 psi, and a flexural strength greater than 20 psi. The overall cross section density of the structural element would be less than 62 pounds per cubic foot (buoyant in water). Since the overall cross sectional density of the element is less than the density of the retained liquid, the structural element would not be stable against lateral pressure forces from the retained liquid and the structural element would be buoyant—it would float. As in the previous embodiments, the structural element would be anchored against buoyant and lateral forces by the impervious tensioned liners 7 and 11 held in place by the anchor trenches 14A, 14B, 14C, and 14D and by additional soil anchor points 27. The structural element 34 may also be secured by mechanical anchors 35. The mechanical anchors could be sections of impervious liner, soil anchors, engineered fabric such as geotextile or geogrid, or other methods of mechanical attachment, e.g. screw augers. The additional anchoring 35 may be desirable to provide additional protection against impact forces or other external loads. The embodiment illustrated in FIG. 16 shows the position for placement 35 of mechanical anchors secured in anchor trenches 14B and 14C. The impervious liner 11 may be secured in anchor trench 14A and 14D. Liner 7 can also be anchored in anchor trench 14B and 14D.

These solid wall hollow structures can have a round, oval, square, rectangular, triangular or polynomial cross sectional shape. The outer surface of each shape is solid and therefore creates a liquid barrier. The interior of the structure is hollow.

In one embodiment, the round cross sectional structure can be a pipe. The each pipe segment can be joined or attached to the next pipe segment. The joined or attached pipe segments can create a liquid tight connection. The pipe sections may thread together, e.g., one pipe segment for a female threaded coupling that fits over a male complementary threaded structure of the next pipe segment. In another embodiment, the adjacent ends of the pipe segments may be glued together to form a liquid tight connection.

Figure 17:
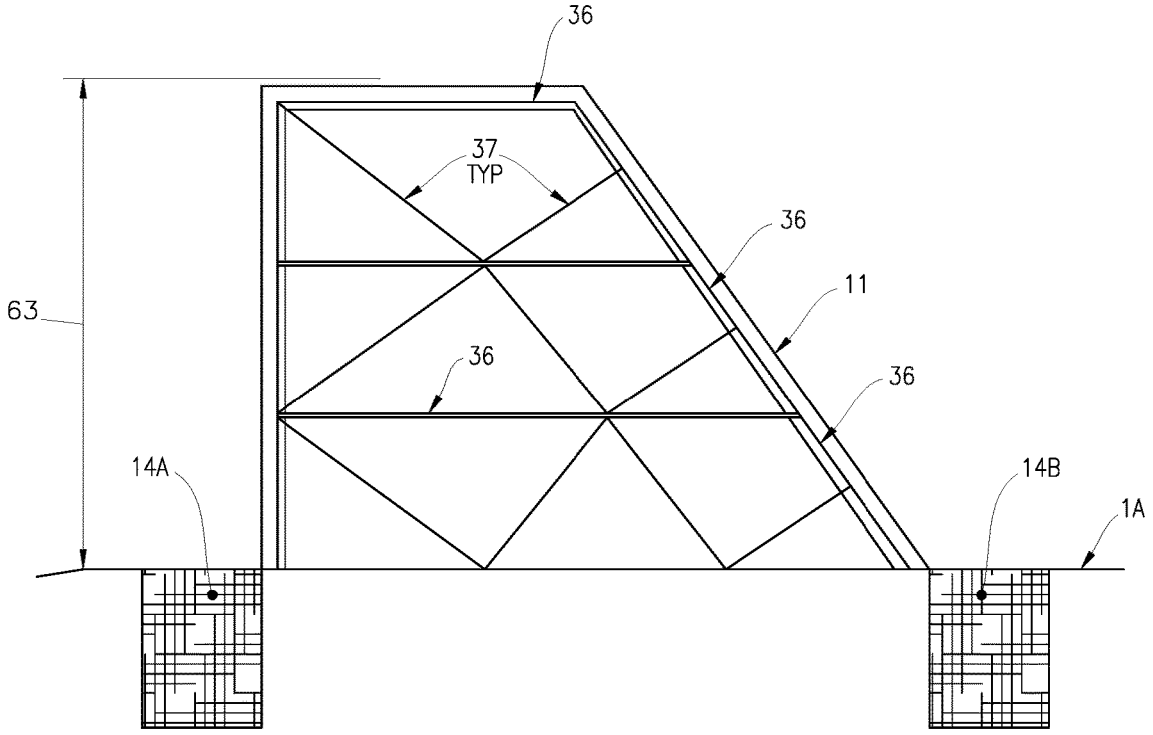
FIG. 17 illustrates another cross sectional view of an embodiment where a lightweight structure comprising a solid wall hollow structure 36 is positioned upon the top surface of a berm 15. The structure 36 serves as an elevated barrier above the top of the berm 15. Here the structure comprises a plurality of flat sides. This allows the positioning of addition structures on top the lightweight structure for further elevation above the top of the berm. Again the structure can be covered by an extension of the liquid impenetrable liner over the structure. Note the structure may contain a plurality of internal struts 37 to strengthen the structure.

In another embodiment, the solid wall hollow structures can incorporate reinforcing internal bracing components. This is illustrated in FIG. 17. These reinforcing internal bracing components 37 can strengthen the structure against the compressive force of the retained liquid exerted upon the exterior surface 36 of the structure. This compressive force will act upon the retention structure in a horizontally oriented direction.

FIG. 17 illustrates another embodiment where a lightweight structure comprising a solid body hollow structure is positioned upon the top surface of a berm 1A. The structure serves as an elevated barrier 63 above the top of the berm 1A. Here the structure comprises a plurality of flat sides 36. This allows the positioning of additional structures a top the lightweight structure for further elevation above the top of the berm. Again the structure can be covered by an extension of the liquid impenetrable liner 11 over the structure. The liner positioned over the structure is anchored at each side of the anchor trench structure 14A and 14B by burying the ends of the liner and back filling each anchor trench. As discussed above, the liner can serve as a structural element to hold the lightweight structure in position. This can require installing the liner under tension.

This reinforcement internal bracing components by be particularly helpful against the crushing compressive force impacting square or rectangular shaped solid wall hallow shaped structures comprising square or rectangular shapes. In a preferred embodiment, the square or rectangular cross-sectioned solid wall hollow body elements each contains their own system of internal bracing. This permits multiple solid wall hollow body structures to be stacked on top of each other, there by increasing the height that the liquid retention structure can be raised. This is not possible with other structures that incorporate braces or frames that extend outside the surface of the solid wall hollow structures. It will be appreciated that the multiple solid wall hollow body structures can be attached together by sealing adhesives such as polyurethane, acrylic latex, silicon, or other commercially available joint sealants. The specific sealant or sealing adhesive could be selected based on the specific design requirements and configuration of the panel materials utilized. Sealants would typically conform to ASTM C920—Standard Specification for Elastomeric Joint Sealants. Alternatively, mechanical components such as but not limited to clips, screws, clamps or self contained bracket and bracket holders could be used.

Figure 18:
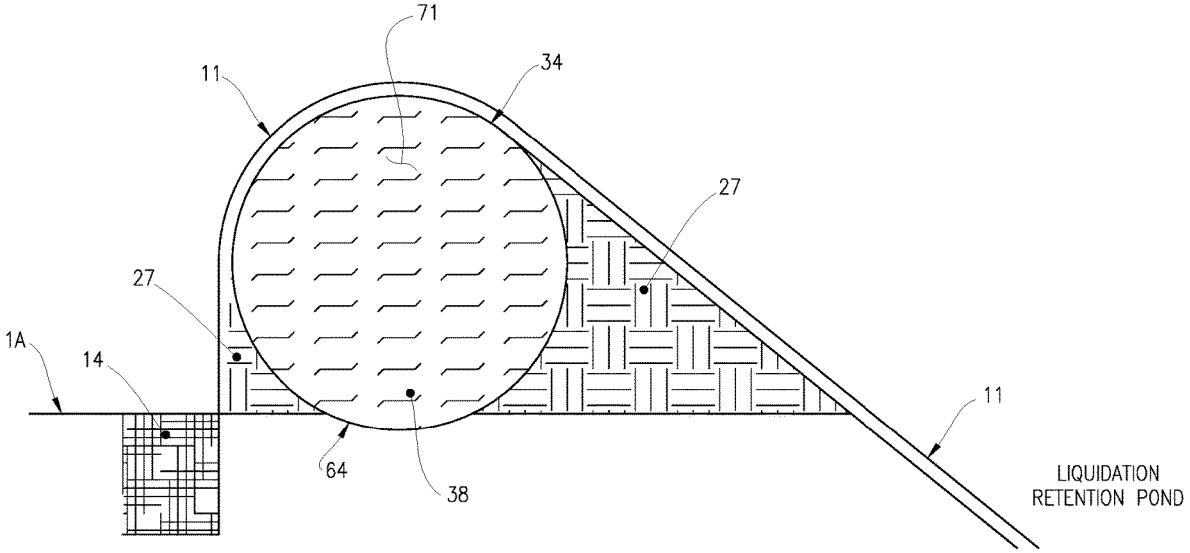
FIG. 18 illustrates a cross sectional view of a geotube 950. The geotube has flexible sidewalls and hollow interior spaces. The geotube is filled with suitable material 951 such as sand, silt, etc. A liquid impervious liner 953 is positioned over the geotube. The liner is secured beneath the geotube by extending the liner into the ground 952 using anchor trenches backfilled with soil 954 or other material. The material can be hydraulically pumped into the hollow interior spaces.

FIG. 18 illustrates a curved, thin wall, liquid impervious barrier 34 placed on the top of a berm. The barrier is covered with a liquid impervious barrier 11 that extends into the liquid retention pond. The barrier or liner extends into an anchor trench 14 that when filled, anchors the liner. The liner may be anchored under tension. The liquid impervious barrier is hollow. This cavity 38 can be filed with soil, sand, silt or similar material 71. In another embodiment, the hollow body structure can be position in a hollow 64 excavated in the berm crest. This can facilitate holding the hollow body structure in position of the berm crest.

It will be appreciated that the Applicant's disclosure does not require bracing or support components extending outside the solid wall hollow body retention structure that can be placed a top of the retention berm.

In other embodiments, the solid wall hollow structures can be modified by placing materials within some or all of the interior hollow portion of the structures. Materials may comprise material including but not limited to soil, sand, silt, dredge spoils, granular fill, lightweight foam material, or concrete. (These materials will herein after referred to as "sand, soil, and silt").

Figure 19:
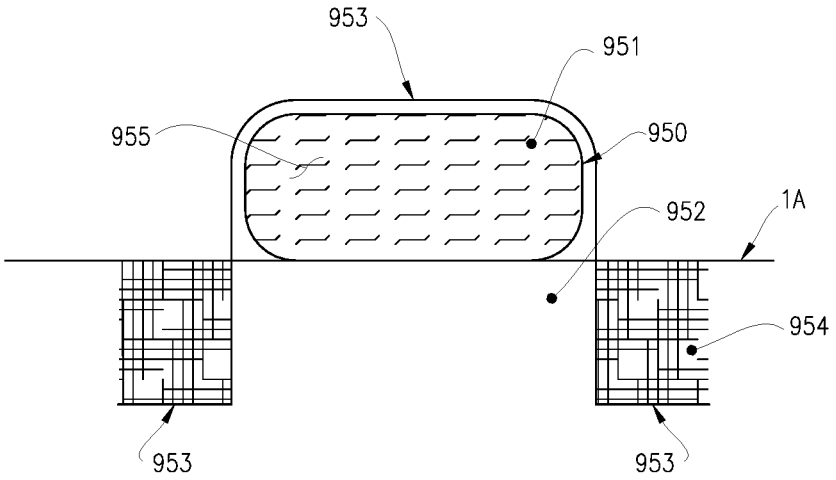
FIG. 19 is another cross sectional view of the structure 900 subject of this disclosure. The structure is comprised of multiple components. Part of the structure 900 is a rigid foam lightweight material 902. A liquid impenetrable liner 903 is positioned over the lightweight material. The liner 903 is anchored 954.

In this Embodiment H illustrated as FIG. 19, lightweight fill material is replaced with a lightweight and flexible geotube material 950. The geotube is a geotextile fabric formed into a hollow tubular shape 955. A suitable fill material 951 such as sand, soil or silt may be hydraulically placed into the tube and allowed to dewater through the liquid permeable geotextile fabric of the geotube. Hydraulic placement can be pumping material into the annulus or hollow structure 955 of the tubular geotube. In this method a soil structure can be formed. In one embodiment, the geotextile is coated with a liquid impervious layer. For example the geotextile can be coated with a polyurea.

The coated liner is either secured in anchor trenches 953 or bonded to an existing liner as in the previous embodiments. The geotube 950 is on the berm crest 1A. (The berm crest is the top of the berm 952.) The fill material would be placed into the geotube as per standard industry practice. After the fill material has dewatered, the fluid impervious liner would be installed as in the previous embodiments.

Figure 20:
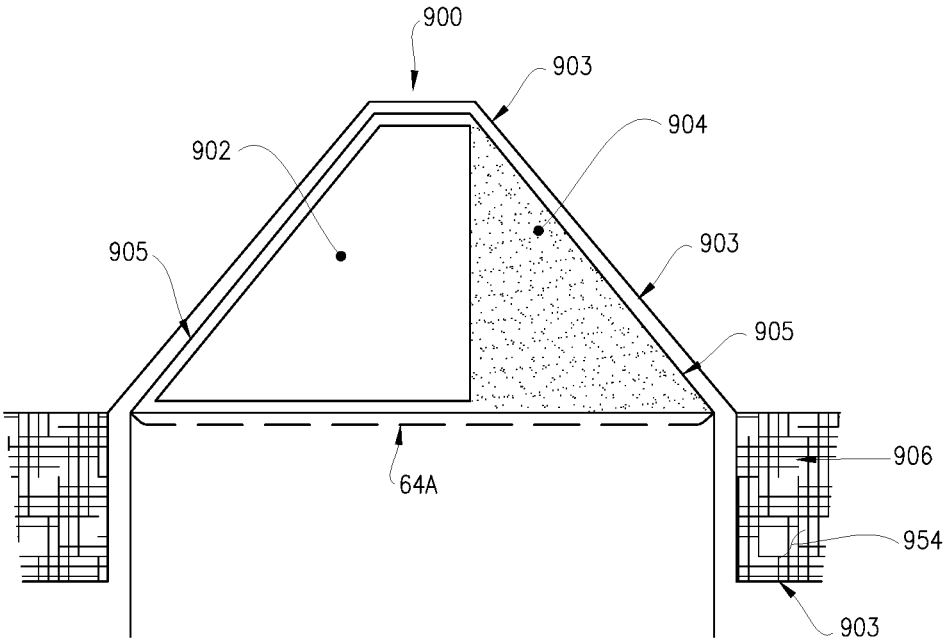
FIG. 20 illustrates a cross sectional view of a structure 900 subject of the disclosure. The structure includes a stacked lightweight fill material 12. The lightweight fill material is secured by a permeable geotextile 11A positioned with one or more anchor trenches 14A-14D. An additional geotextile liner 39 is positioned over the lightweight material. The geotextile lining 39 is anchored utilizing anchor trenches 14B and 14C. The liner can also be secured utilizing anchors 40 placed in a trench 14B, 14C. Sand or other material 40 that can be pumped can be placed adjacent to the lightweight fill material 12 and within a cavity formed beneath the geotextile 39. In one embodiment, shotcrete can be placed on the outside of the liner 39 or 11.

In this Embodiment I illustrated in FIG. 20, the rigid foam lightweight fill system 900 comprising rigid foam lightweight fill material 902 is secured with a liquid permeable geotextile 905. The geotextile is secured in deep anchor trenches 906. The lightweight fill material may be mechanically anchored or set slightly into the ground 64A to provide additional stability. (It will be appreciated that the an open space 64A is excavated and the system 900 place within the excavation for added stability.) The fill material is bounded by the geotextile, the lightweight fill material, and the existing ground. A suitable fill material, e.g., soil, sand or silt is hydraulically placed into the annulus of the geotextile and allowed to dewater via seepage through the liquid permeable geotextile material. The geotextile material must be sufficiently anchored to hold the (lateral) force or load of the hydraulically conveyed suitable fill material. The suitable hydraulic conveyed materials could be soil, sand or a suitable silt with cementations properties. These materials will have greater mass than the lightweight fill material. The cementations properties allow the fill material to solidify with dewatering. This suitable material could provide impact resistance or reinforcement to the lightweight fill structure, i.e., in the case of a levee along a river or shoreline where floating debris could be present. After placement of the suitable fill material, the fluid impermeable liner would be installed in a second set of anchor trenches. The liquid impermeable liner 903 provides the liquid barrier. The impervious liner is shown in FIG. 20 covering both the suitable fill material and the lightweight fill material. In one embodiment, the suitable fill material is placed proximate to the liquid held in the retention pond.

In another version of Embodiment I, the rigid foam lightweight fill 12 ("lightweight fill") could be anchored with liquid impervious liner 11 extending across the top and over each side of the structure 101 and secured in each anchor trench 14A and Beneath the liner can be a geotextile 39 stretched over the lightweight fill 12 to form an open space 40 on each side of the lightweight fill. See FIG. 21. The geotextile 39 is taut over the lightweight fill material. The taut geotextile can hold the rigid foam lightweight fill material in place. This taut condition is created by holding the liner under tension. Similar to above, suitable fill 41 (e.g., soil, sand or silt) would be placed beneath the liquid impervious liner 11 and on each side of the open space 40 adjacent to the rigid foam lightweight fill material 12. This fill material will provide impact resistance to the foam and protect the impervious liner from mechanical and ultraviolet damage from the sun. A second impervious liner 39 could be installed over the entire assembly to provide additional impervious qualities.

Figure 21:
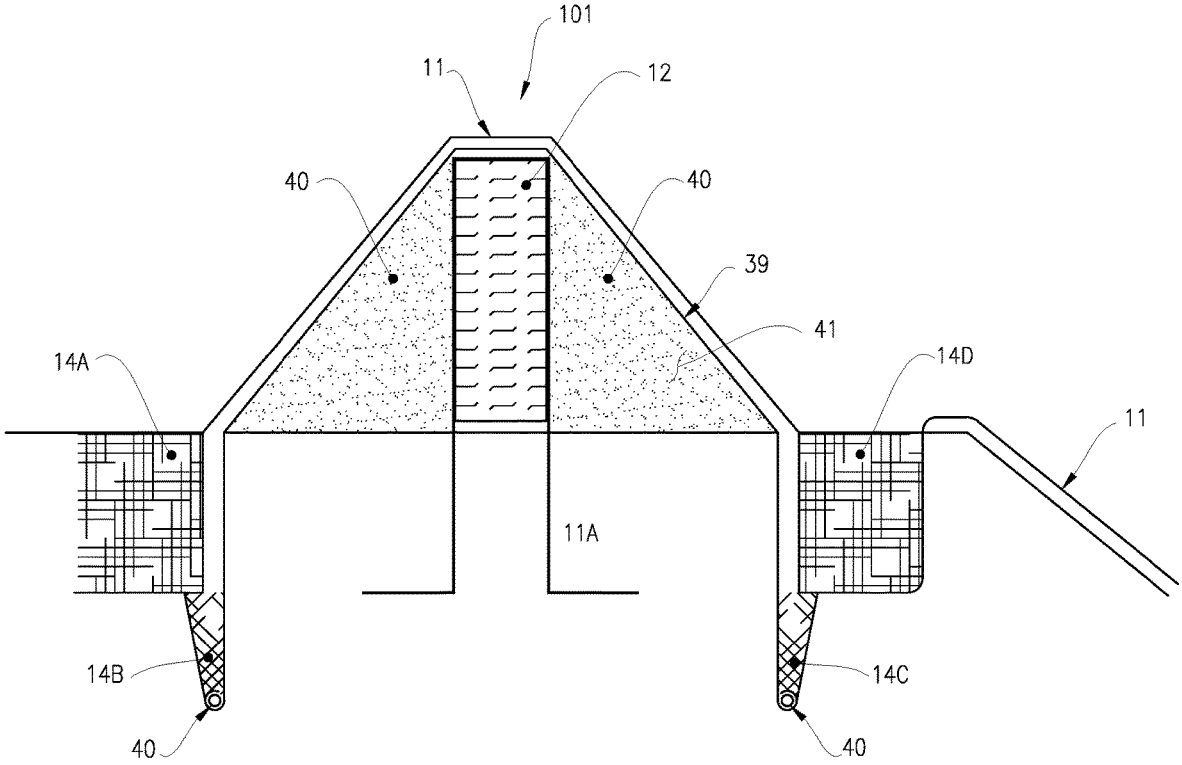
FIG. 21 is another cross sectional view of a structure 900 subject of this disclosure. The structure comprises lightweight fill material comprised of rigid foam 910. The lightweight foam material can be stacked into a vertically oriented 960 structure 900. The structure is secured by a liner 911 that covers the lightweight fill material 910. The liner may be placed taut over the structure. The liner is secured by buried in an anchor trench 912. In the embodiment shown, soil 913 is positioned and stacked over the liner 911 securing the light weight fill material 910 of the structure 900. The soil may be seeded or, alternatively, loam may be placed.

An assembly such as illustrated in FIG. 21 may be desirable on top of flood control levees that are accessible by the general public. The fill material 40 on either side of the structure 101 would provide protection from vandalism, vehicular impact and other devious or accidental damages that can occur to remotely located structures.

Figure 22:
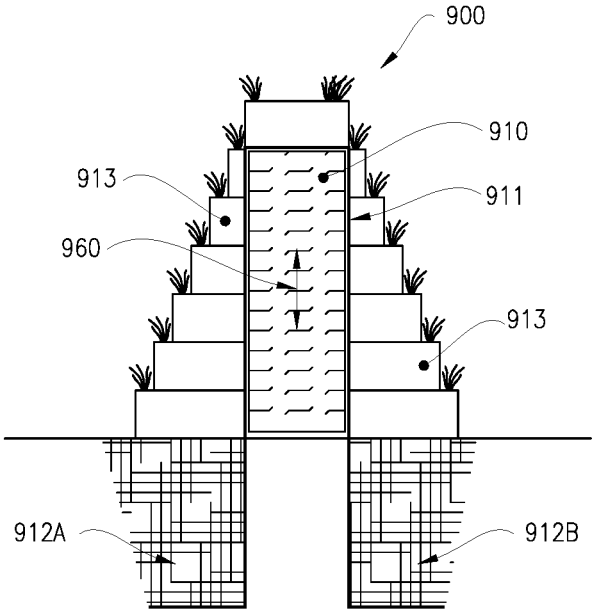
FIG. 22 illustrates another embodiment similar to FIG. 21. The structures embodies two vertically oriented structures 915, 916. The structures can comprise stacked lightweight material 910. The lightweight material is secured in place by means of a tautly installed liquid impermeable liner 917, 930. The liner is secured by placing the liner ends within an excavated anchor trench 918, 919 that is then back filled with soil.

In another embodiment 900 shown in FIG. 22, the rigid foam lightweight fill material 910 ("lightweight fill") is constructed in a vertical orientation 960. The lightweight fill is again secured by the liquid impervious liner 911. The liquid impervious liner can be secured in each of the anchor trenches 912A and 912B. Commercially available materials and systems are then utilized to produce a soil filled and vegetated exterior covering 913 over and around the impervious liner. This vegetated cover would protect the liquid impervious liner from vandalism and UV damage. This embodiment could again be useful in public locations where protection against vandalism and aesthetics are important. Additionally, the system shown below could be used to construct flood walls where there is no existing berm or levee.

Figure 23:
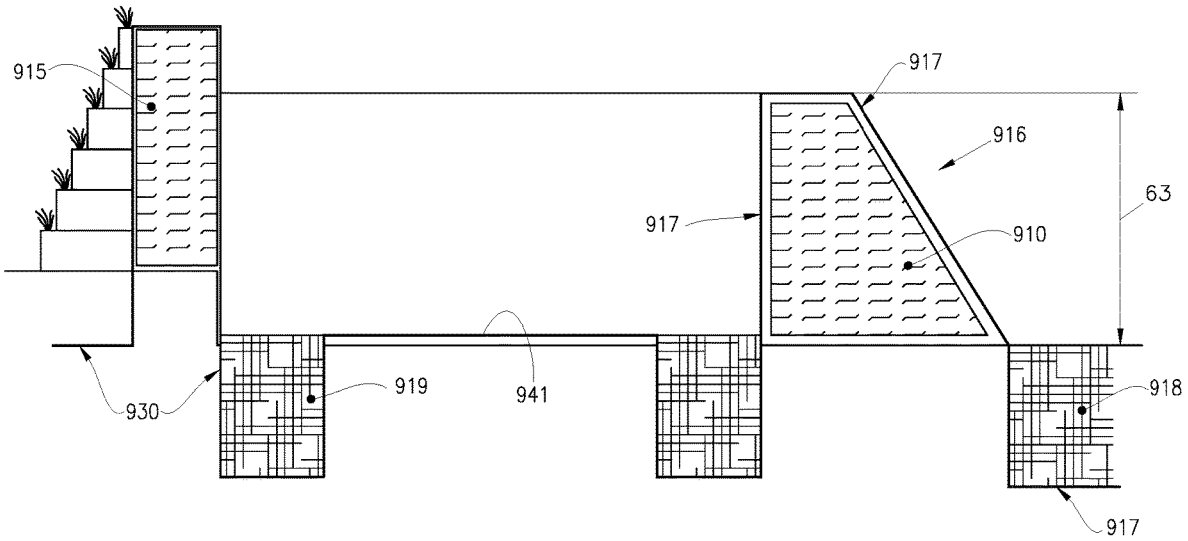
FIG. 23 illustrates a side view of an embodiment wherein a vertical structure created from stacked rigid foam lightweight material 920. A liquid impenetrable liner 921 is positioned over the lightweight fill material. The liner is secured by each end 922, 923 placed in an anchor trench. The structure illustrated in FIG. 23 also demonstrates creating an elevated liquid retention structure to accommodate an existing sloped structure.

In another embodiment (Embodiment J) is illustrated in FIG. 23. FIG. 23 illustrates that combinations of the previously disclosed systems could be used to form a pond, a swimming pool, or other structure. The rigid foam lightweight fill materials ("lightweight fill") 910, 915 could be utilized to form walls 916 of the desirable height 63 and secured with one or more impervious liners 917. Note that the impervious liner 917 extends from the pool structure 941 to the inner portion of the wall 916, over the top of the wall and into an anchor trench 918. The liquid impervious liners can be secured utilizing anchor trenches. The internal area would be impervious and contain liquid. The internal space could be further supplemented by a commercially available pool liner for decorative and further impervious properties.

This method of constructing a liquid containment structure could be of particular use in locations where equipment access is limited.

Figure 24:
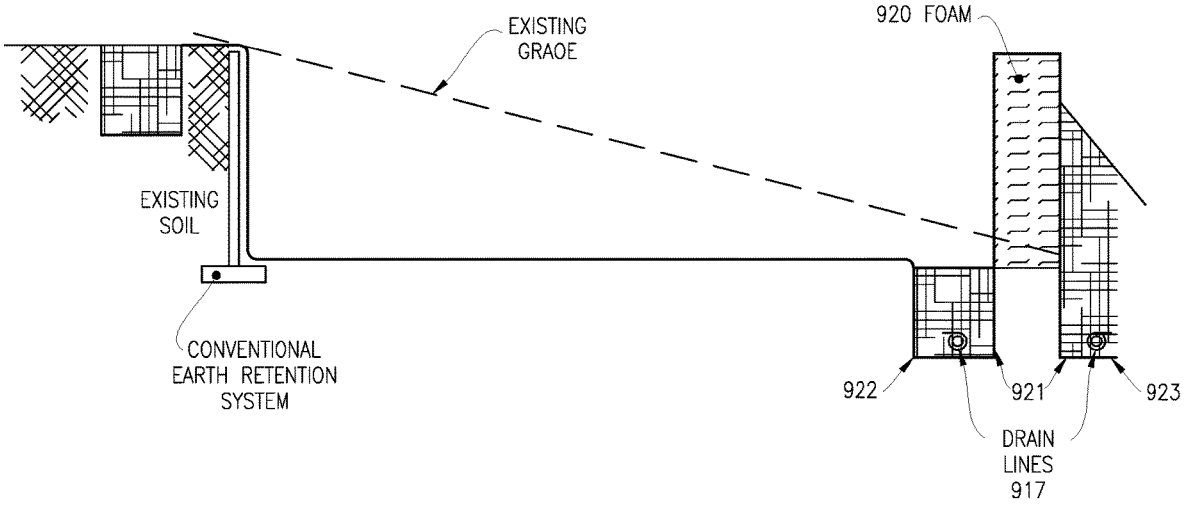
FIG. 24 illustrates a side view of an additional configuration (Embodiment K). In locations where sloped terrain is present, lightweight fill material can be used in combination with traditional systems to create containment structures.

FIG. 24 illustrates an additional configuration (Embodiment K). In locations where sloped terrain is present, the disclosed lightweight fill material 920 system could be used in combination with traditional systems to create containment structures. Illustrated in FIG. 24 is a conventional earth retention system. An additional benefit of the lightweight fill 920 (constructed in a vertical wall) and liner system 921 (extending over the top of the lightweight fill) is the inherit flexibility of this combination. As traditional containment systems constructed out of concrete or fiberglass are strong, yet brittle, they are easily damaged during earthquake events. The flexibility of lightweight fill and liner will allow deflection and movement without causing loss of containment due to cracking of the concrete structure. The liner is held in place by anchor trenches 922, 923. Also illustrated are optional drain lines contained with the soil of the anchor trench. Embodiment A (FIG. 3) could be constructed to allow the addition of a leak collection and detection system in between the existing primary liner 7 and the new liner 11. This could be required to satisfy certain regulatory requirements or provide a means of monitoring the integrity of the attachment point 13. FIG. 24 also discloses a leak detection system or drain lines 917. It will be appreciated that such a system could be provided for any of the embodiments disclosed herein by the Applicant. A leak detection system is traditionally constructed of perforated pipe (typically PVC or HDPE) installed to collect any liquid that leaks from the containment system. The collected liquid is routed to a collection sump where it can be monitored or pumped back into the containment area.

This specification is to be construed as illustrative only and is for the purpose of teaching those skilled in the art the manner of carrying out the disclosure. It is to be understood that the forms of the disclosure herein shown and described are to be taken as the presently preferred embodiments. As already stated, various changes may be made in the shape, size and arrangement of components or adjustments made in the steps of the method without departing from the scope of this disclosure. For example, equivalent elements may be substituted for those illustrated and described herein and certain features of the disclosure maybe utilized independently of the use of other features, all as would be apparent to one skilled in the art after having the benefit of this description of the disclosure.

While specific embodiments have been illustrated and described, numerous modifications are possible without departing from the spirit of the disclosure, and the scope of protection is only limited by the scope of the accompanying claims.

What is claimed is:

1. A liquid retention barrier system comprising:

a) a barrier structure comprising a lightweight solid foam fill structure positioned on a ground or berm surface and having a vertical height above the surface;

b) a taunt fluid permeable fabric or geotextile extended over the lightweight foam fill structure;

c) a hollow interior space positioned (i) beneath the fluid permeable fabric, and (ii) adjacent to the lightweight foam fill structure;

d) one or more anchors securing the fluid permeable fabric to the ground or berm surface;

e) one or more openings in the fluid permeable fabric adapted to convey placement of material into the hollow interior space;

f) material positioned in the hollow interior space;

g) a taut liquid impermeable liner extending over the lightweight foam fill structure; and h) one or more anchors that secures the taut liquid impermeable liner to the ground or berm surface.

2. A liquid retention barrier system of claim 1 further comprising a second quantity of fill material positioned next to the lightweight solid foam fill structure.

3. The liquid retention barrier system of claim 2 wherein the second quantity of fill material comprises soil, sand, gravel, silt or dredge soils.

4. The liquid retention barrier system of claim 2 further comprising a fabric wherein the fabric may be positioned over a portion of at least one fill material.

5. A method of constructing a liquid retention barrier comprising:

a. placing a lightweight foam structure at an intended location for a liquid retention barrier wherein the lightweight foam structure has a density less than 5 pounds per cubic foot, compressive strength greater than 2 psi and flexural strength greater than 10 psi;

b. placing a taunt fluid permeable fabric or geotextile over the foam structure and anchoring the fabric to the ground or berm to secure the foam in position and create at least one hollow interior space beneath the taut fluid permeable fabric adjacent to the foam;

c. placing fill material into the hollow interior space through openings provided in the fabric;

d. placing a fluid impermeable liner under tension over the foam and permeable fabric; and e. anchoring the taut fluid impermeable liner to the ground or berm surface.

6. A method of constructing a liquid retention barrier comprising:

a. placing a lightweight foam structure at an intended location for the liquid barrier wherein the lightweight foam structure has a density less than 5 pounds per cubic foot, compressive strength greater than 2 psi and flexural strength greater than 10 psi;

b. securing the foam structure to the ground or berm using a first taut liner stretched over the foam structure and the first taut liner is secured to the ground or berm;

c. creating at least one hollow interior space beneath the first taut liner and adjacent to the foam structure;

d. placing fill material into the hollow interior space through openings provided in the first liner;

e. placing a second fluid impermeable liner over the foam and the first liner under tension; and f. anchoring the resulting taut fluid impermeable liner to the ground or berm surface.

7. The method of claim 6 further comprising placing concrete or shotcrete panels over the first liner in substitution for the second fluid impermeable liner.

8. A method of constructing a liquid retention barrier comprising:

a. placing a lightweight foam structure at the intended location of the liquid barrier wherein the lightweight foam structure having density less than 5 pounds per cubic foot, compressive strength greater than 2 psi and flexural strength greater than 10 psi;

b. securing the foam structure to the ground or berm using a taut or stretched fluid impermeable liner that is placed over the foam structure and secured to the ground or berm under tension; and c. placing a soil filled and vegetated exterior covering on at least one side of the taut fluid impermeable liner and lightweight foam structure to protect the fluid impermeable liner and provide resistance to horizontal fluid or wind loads.

* * * * *